US006070040A

United States Patent [19]

Goto et al.

[11] Patent Number: 6,070,040

[45] Date of Patent: May 30, 2000

[54] DEVELOPMENT DEVICE

[75] Inventors: Hiroshi Goto, Kawanishi; Yoichi Fujieda, Nishinomiya; Shuichi Nakagawa, Suita; Ryuji Inoue, Itami, all of Japan

[73] Assignee: Minolta Co., Ltd., Osaka, Japan

[21] Appl. No.: 09/252,027

[22] Filed: Feb. 18, 1999

[51] Int. Cl.[7] ..... G03G 15/08

[52] U.S. Cl. ..... 399/285; 399/279

[58] Field of Search ..... 399/285, 279, 399/281, 282, 286, 55

[56] References Cited

U.S. PATENT DOCUMENTS 5,136,335 8/1992 Takeda et al. .

*Primary Examiner*—Richard Moses

*Attorney, Agent, or Firm*—Burns, Doane, Swecker & Mathis, LLP

[57] ABSTRACT

A development device according to the invention has an arrangement wherein a developer carrying member holding a toner thereon and an image bearing member with an electrostatic latent image formed thereon oppose each other across a predetermined gap therebetween, and a power unit applies an alternating voltage to the gap for supplying the toner from the developer carrying member to the image bearing member, the development device satisfying any one the following conditions:

$$a \leqq 5\times10^9/f, \text{ and } 5\times10^8/f \leqq -b \leqq 5\times10^9/f \quad (1)$$

$$-b \leqq 5\times10^9/f, \text{ and } 5\times10^8/f \leqq a \leqq 5\times10^9/f \quad (2)$$

$$5\times10^8/f \leqq (a^2+b^2)^{1/2} \leqq 5\times10^9/f \quad (2)$$

where a (Ω) denotes a resistance component of an impedance (a+b·i) of the developer carrying member, −b (Ω) denotes a capacitative reactance component of the impedance thereof, and f (Hz) denotes a frequency of the alternating voltage.

21 Claims, 21 Drawing Sheets

DEVELOPMENT DEVICE

BACKGROUND OF THE INVENTION

This application is based on application No. 37269/1998 filed in Japan, the contents of which is hereby incorporated by reference.

1. Field of the Invention

The present invention relates generally to a development device which is used in image forming apparatuses, such as copying machines, printers and the like, for developing an electrostatic latent image formed on an image bearing member. In particular, the invention relates to a development device which is arranged such that a developer carrying member for holding a toner thereon and the image bearing member with the electrostatic latent image formed thereon oppose each other across a predetermined gap therebetween and an alternating voltage is applied to the gap for supplying the toner from the developer carrying member to the image bearing member, the development device adapted to produce the image which does not suffer a significant variations in image density or has a stable image density even if the gap between the developer carrying member and the image bearing member varies.

2. Description of the Related Art

The image forming apparatuses, such as the copying machines and printers, have heretofore employed various types of development devices for development of the electrostatic latent images formed on the image bearing members. The known development devices include those utilizing the two component developer comprised of a carrier and a toner, and those utilizing the single component developer free from the carrier.

As the development device of the single component development system, there have been known a contact type development device arranged such that the developer carrying member comes into contact with the image bearing member at a development zone and introduces the developer to the development zone for developing the latent image, and a non-contact type development device arranged such that the developer carrying member opposes the image bearing member across a predetermined gap therebetween and introduces the developer to the development zone opposite to the developer carrying member, thereby accomplishing the development of the latent image.

The contact type development device features an excellent reproducibility of the electrostatic latent image formed on the image bearing member because the latent image is developed by bringing the developer into contact with the image bearing member. However, the developer also adheres to a non-image area of the image bearing member so that the produced image suffers fogging.

Hence, the prior-art development device is designed to prevent the developer from adhering to the non-image area by varying a moving speed of the image bearing member from that of the developer carrying member.

In as much as the contact-type development device has the developer carrying member pressed against a surface of the image bearing member at a given pressure, the developer carrying member moving at the different speed relative to the image bearing member causes abrasion of the surface of the image bearing member. Consequently, the production of images with a stable density is not ensured.

In the non-contact type development device with the developer carrying member opposing the image bearing member across the predetermined gap therebetween, the surface of the image bearing member is not abraded by the developer carrying member. However, significant density variations of the produced images result from the varied gap, at development zone, defined by the developer carrying member and the image bearing member in opposing relation. In a case where a minor variation in the gap between the image bearing member and the developer carrying member results from poor forming precisions of the image bearing member and the developer carrying member, for example, the produced images suffer density variations. Hence, the images with a stable density cannot be obtained.

SUMMARY OF THE INVENTION

It is therefore an object of the invention to provide a development device arranged such that a developer carrying member holding a toner thereon and an image bearing member with an electrostatic latent image formed thereon define a predetermined gap therebetween, an alternating voltage is applied to the gap for supplying the toner from the developer carrying member to the image bearing member in non-contacting relation with the developer carrying member, the development device adapted to reduce the density variations of the produced images despite the varied gap between the developer carrying member and the image bearing member thereby ensuring the production of favorable images with a constant image density.

A first development device according to the invention comprises a developer carrying member holding a toner thereon and opposing an image bearing member with an electrostatic latent image formed thereon across a predetermined gap therebetween, and a power unit for applying an alternating voltage to the gap between the developer carrying member and the image bearing member for supplying the toner from the developer carrying member to the image bearing member, the development device satisfying relations:

$$a \leqq 5\times10^9/f, \text{ and } 5\times10^8/f \leqq -b \leqq 5\times10^9/f \quad (1)$$

where a (Ω) denotes a resistance component of an impedance (a+b·i) of the developer carrying member, −b (Ω) denotes a capacitative reactance component of the impedance thereof, and f (Hz) denotes a frequency of the alternating voltage.

A second development device according to the invention satisfies relations:

$$-b \leqq 5\times10^9/f, \text{ and } 5\times10^8/f \leqq a \leqq 5\times10^9/f \quad (2)$$

A third development device according to the invention satisfies a relation:

$$5\times10^8/f \leqq (a^2+b^2)^{1/2} \leqq 5\times10^9/f \quad (3)$$

If the resistance component "a" and the capacitative reactance component "−b" of the impedance (a+b·i) of the developer carrying member and the frequency "f" of the alternating voltage satisfy any one of the aforementioned conditions, as in the first to third development devices according to the invention, strength variations of the electric field applied between the developer carrying member and the image bearing member decrease despite the varied the gap between the developer carrying member and the image bearing member. This contributes to reduced variations in the density of the produced images. In addition, a suitable strength of electric field is applied between the developer carrying member and the image bearing member so that images sufficient and stable in density are produced.

For defining the aforementioned conditions of the invention, an examination was made on how the strength of the electric field applied between the developer carrying member and the image bearing member varied in association with each ±0.05 mm variation of the gap "d" between the developer carrying member and the image bearing member. The examination was conducted under the following conditions, for example: a relative dielectric constant $\in_P$ of the image bearing member set to 3.0; a thickness of a photoconductive layer of the image bearing member set to 20 $\mu$m; an area of the development zone set to 1500 $mm^2$ where the image bearing member is opposed by the developer carrying member; a peak-to-peak value $V_{PP}$ of 2000 V of the alternating voltage applied between the developer carrying member and the image bearing member; various frequencies "f" of the alternating voltage applied between the developer carrying member and the image bearing member; and various resistance components "a" and capacitative reactance components "–b" of the developer carrying member. The results are shown in FIGS. 1 to 3.

FIG. 1 shows the field variations where the gap "d" was 0.20 mm and the frequency "f" of the alternating voltage was 2 kHz. FIG. 2 shows the field variations where the gap "d" was 0.30 mm and the frequency "f" was 2 kHz. FIG. 3 shows the field variations where the gap "d" was 0.20 mm and the frequency "f" was 4 kHz. The figures also show how the field strength varied in association with each of the various resistance components "a" and capacitative reactance components "–b" of the developer carrying member. In these figures, hollow circles represent the field strengths when the gap "d" was 0.05 mm increased from a set value whereas solid circles represent the field strengths when the gap "d" was 0.05 mm decreased from the set value.

In order to ensure that a reduced difference is obtained between a field strength in the gap "d" 0.05 mm increased from the set value and a field strength in a gap "d" 0.05 mm decreased from the set value and that a sufficient amount of toner is supplied from the developer carrying member to the image bearing member, there were determined respective ranges of the above parameters that achieve the field strength of not less than $2\times10^6$ V/m. The aforesaid relations 1 to 3 were derived from these ranges thus determined.

It is to be noted here that the development device of the invention may employ the developer carrying member which does not include a magnetic member. Usable as the developer hereof is a single component developer free from the carrier. The single component developer may be a magnetic toner containing a magnetic powder or a non-magnetic toner free from the magnetic powder.

According to the development device of the invention, the electron conductive material is preferably used for imparting the impedance to the developer carrying member.

The use of the electron conductive material for imparting the impedance to the developer carrying member is effective to reduce the variations in the electric field applied between the image bearing member and the developer carrying member when the environmental conditions around the development device, such as temperature, humidity and the like, vary. This further ensures the production of images with a more stable density.

According to the development device of the invention, the developer carrying member is arranged such that at least a resilient layer is formed on a conductive roller. Preferably, the resilient layer has a thickness of not more than 2 mm.

By using the developer carrying member wherein at least the resilient layer is formed on the conductive roller, a regulating member for regulating a quantity of toner held by the developer carrying member is prevented from pulverizing the toner particles. With the thickness of 2 mm or less, the resilient layer in the developer carrying member suffers smaller variations in the thickness thereof under the varying environmental conditions including temperature, humidity and the like. Thus, the production of images with the stable density is ensured.

According to a development device of the invention, it is preferred that the aforesaid alternating voltage as well as a direct voltage are applied between the developer carrying member and the image bearing member while the following conditions are satisfied:

$$1.5 \leqq V_{PP}(\text{kV}) \leqq 2.0, \text{ and } |V_o - V_i|/2 \leqq |V_{DC}| \quad (4)$$

where $V_{PP}$ (kV) denotes a peak-to-peak value of the alternating voltage, $V_{DC}$ (V) denotes the direct voltage, $V_o$ (V) denotes a potential of a non-image area of the image bearing member, and $V_i$ (V) denotes a potential of an image area thereof.

If the alternating voltage together with the direct voltage are applied between the developer carrying member and the image bearing member while the peak-to-peak value $V_{PP}$ and the direct voltage $V_{DC}$ satisfy the aforesaid conditions 4, an occurrence of leakage between the developer carrying member and the image bearing member is prevented. This leads to the prevention of appearance of black spots in a background portion of the produced image and also to the reduced field variations caused by the varied gap at the development zone. Accordingly, the production of images with the stable density is ensured.

According to a development device of the invention, it is preferred that the frequency f (Hz) of the alternating voltage applied between the developer carrying member and the image bearing member satisfies a condition of $1000<f<5000$ and that the alternating voltage acts for a shorter period of time to effect an electric field in a toner leading direction toward the image bearing member than to effect the electric field in a toner leading direction toward the developer carrying member.

If the alternating voltage has the frequency limited within the aforesaid range and effects the electric field in the toner leading direction toward the image bearing member in a manner to allow a shorter duration thereof than that of the field in the toner leading direction toward the developer carrying member, the production of images with the suitable density is ensured despite the increased absolute value of the peak-to-peak value $V_{PP}$ of the alternating voltage or of the direct voltage $V_{DC}$.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

Now, a development device according to preferred embodiments of the invention will hereinbelow be described. Based on various examples of the invention, a specific explanation will be made on that the development device satisfying any one of the conditions of the invention provides images which are reduced in density variations and have a sufficient density despite a varied gap between the developer carrying member and the image bearing member.

EXAMPLES 1 to 10

Figure 1:
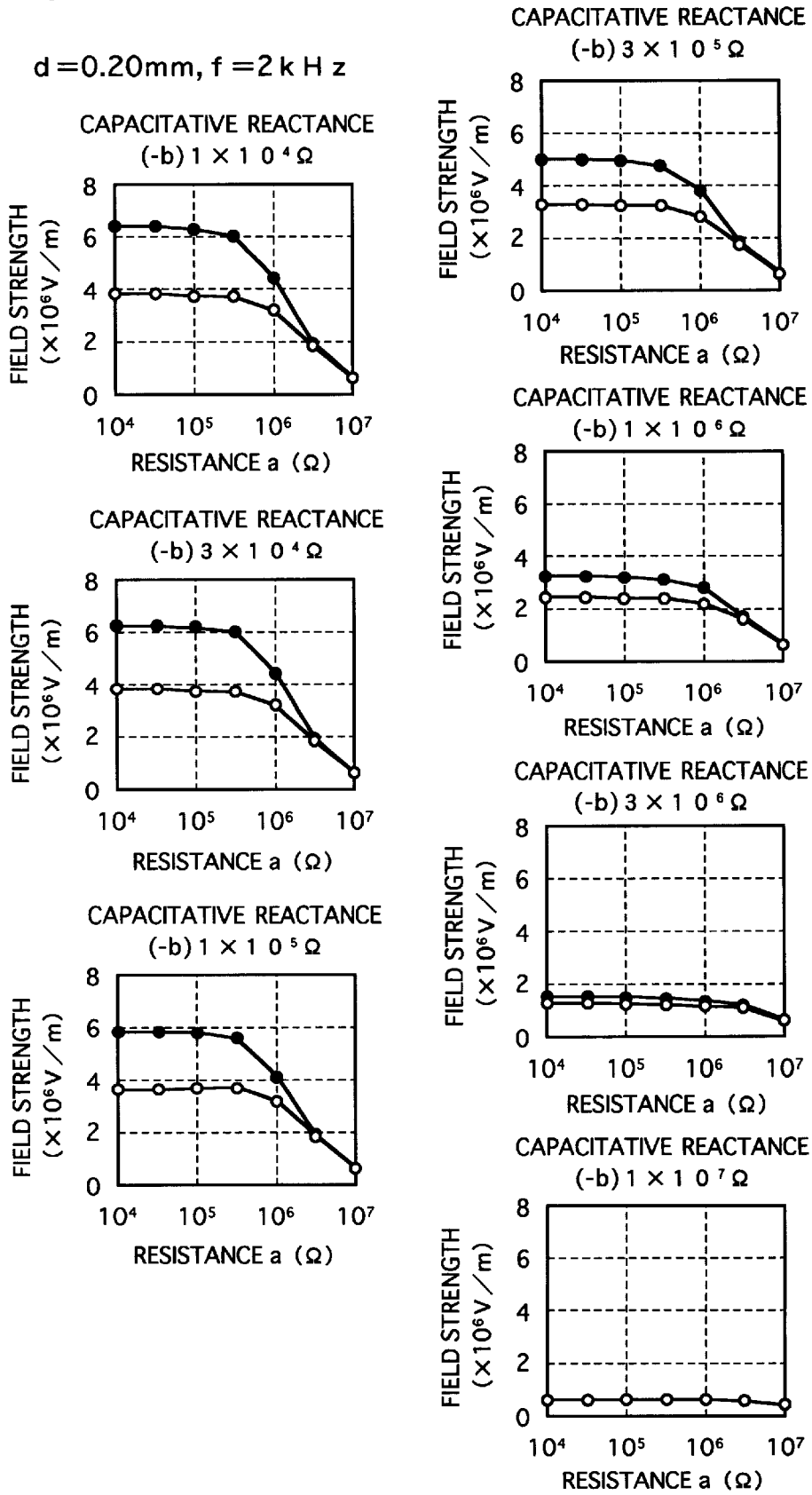
FIG. 1 is graphical representations each showing variations in the strength of an electric field applied between a developer carrying member and an image bearing member under the following conditions: a gap "d" of 0.20 mm between the developer carrying member and the image bearing member; a frequency "f" of 2 kHz of an AC voltage applied between the developer carrying member and the image bearing member; and various resistance components "a" and capacitative reactance components "−b" of the developer carrying member.
Figure 2:
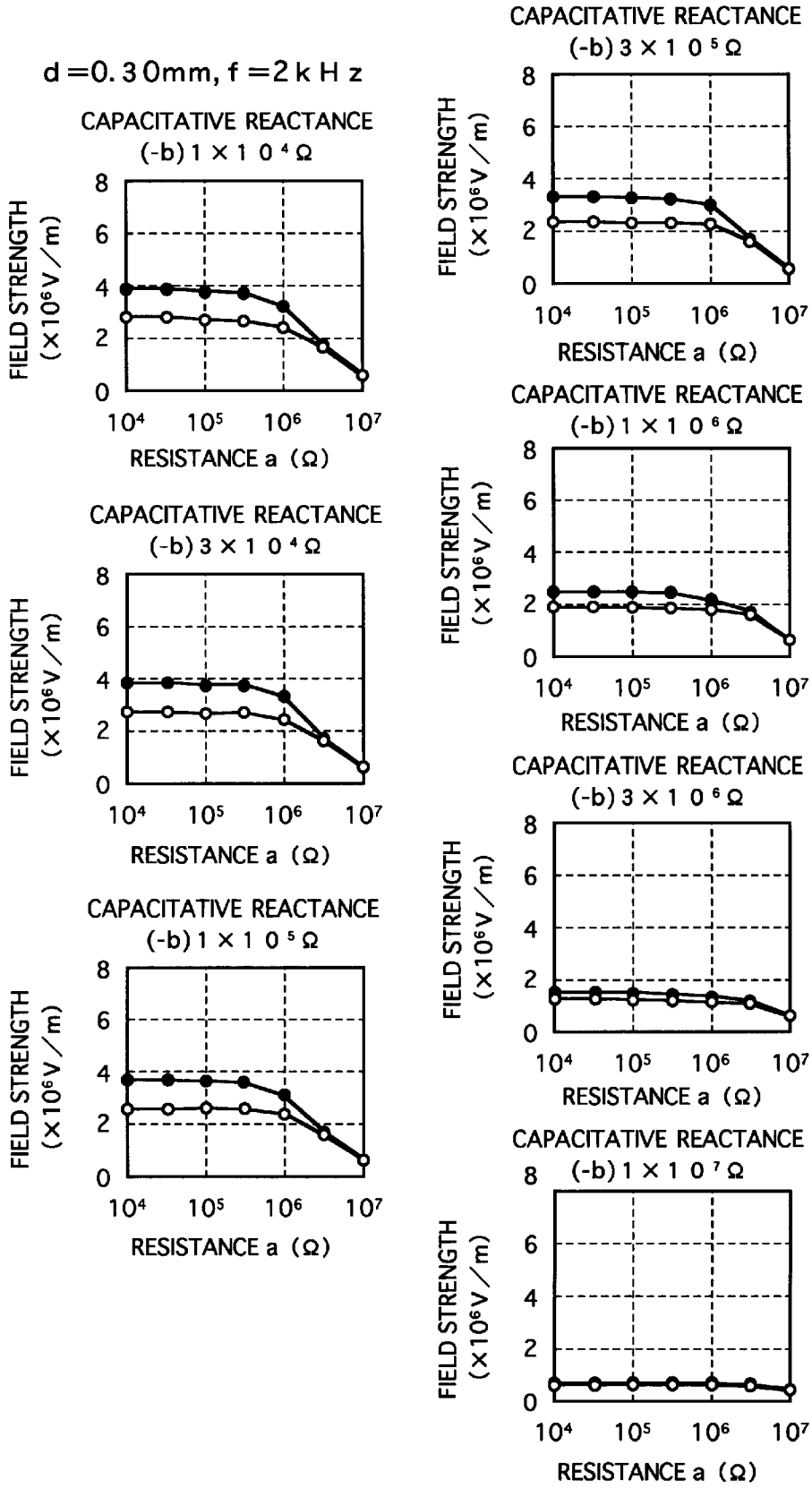
FIG. 2 is graphical representations each showing variations in the strength of the electric field applied between the developer carrying member and the image bearing member under the following conditions: a gap "d" of 0.30 mm between the developer carrying member and the image bearing member; the frequency "f" of 2 kHz of the AC voltage applied between the developer carrying member and the image bearing member; and various resistance components "a" and capacitative reactance components "−b" of the developer carrying member.
Figure 3:
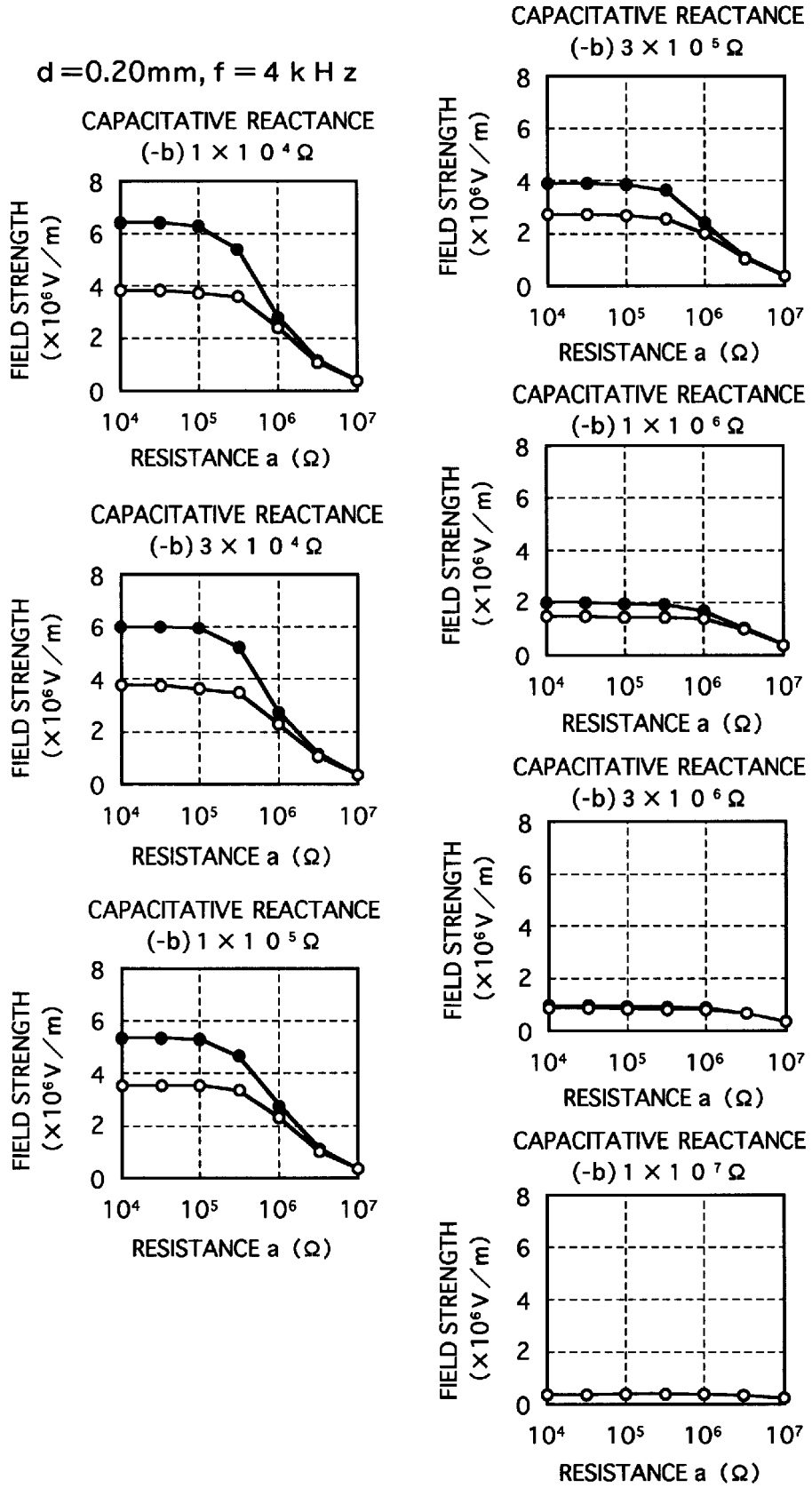
FIG. 3 is graphical representations each showing variations in the strength of the electric field applied between the developer carrying member and the image bearing member under the following conditions: the gap "d" of 0.20 mm between the developer carrying member and the image bearing member; a frequency "f" of 4 kHz of the AC voltage applied between the developer carrying member and the image bearing member; and various resistance components "a" and capacitative reactance components "−b" of the developer carrying member.
Figure 4:
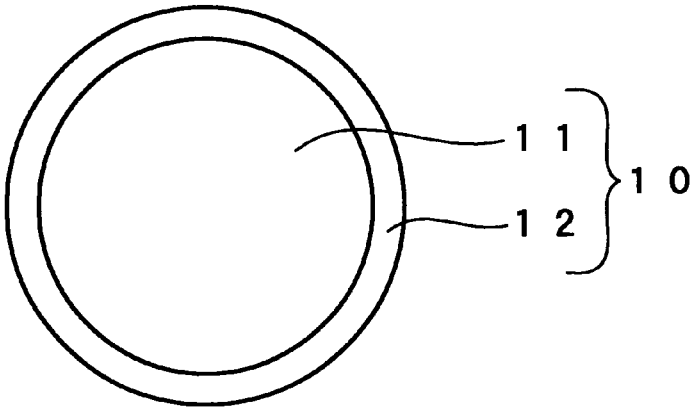
FIG. 4 is a schematic diagram showing the developer carrying member used in examples of the invention.

As shown in FIG. 4, these examples each employed a developer carrying member 10 including a conductive roller 11 formed of a metal and a resilient layer 12 formed of any one of various materials and laid in a thickness of 1 mm on the conductive roller.

In Examples 1 to 3, the resilient layer 12 was formed of an electron conductive material including a silicone rubber to which carbon black was added in different proportions for varying a resistance component and a capacitative reactance component of the layer. In Examples 4 to 6, the resilient layer was formed of an electron conductive material including an ethylene-propylene-diene-methylene rubber (EPDM rubber) to which carbon black was added in different proportions for varying the resistance and capacitative reactance components of the layer. In Examples 7 and 8, the resilient layer was formed of an ion conductive material varied in the resistance and the capacitative reactance components. In Examples 9 and 10, the resilient layer was formed of an epichlorohydrin rubber, a kind of ion conductive material, which was varied in the resistance and capacitative reactance components.

Figure 5:
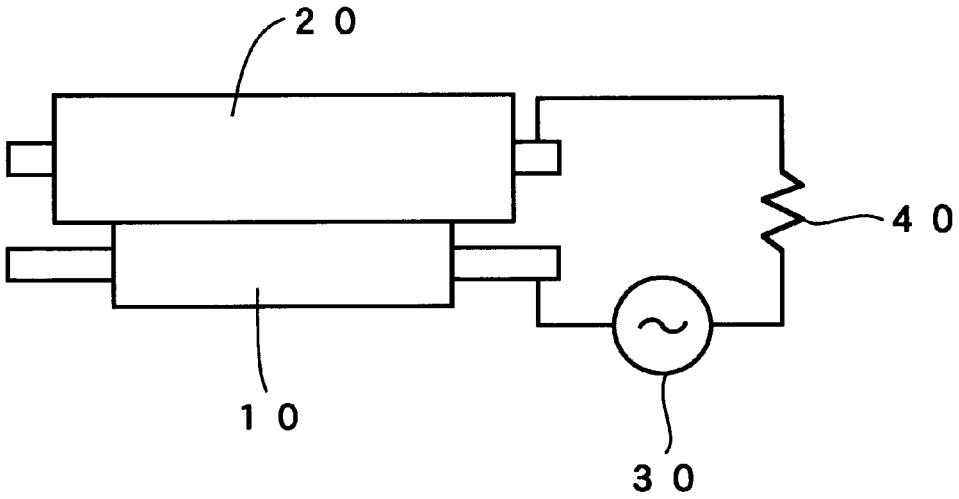
FIG. 5 is a schematic diagram showing an arrangement of a device wherein each of the developer carrying members of the examples of the invention and an electrode roller are disposed in contacting relation with an AC voltage source and a resistance connected thereacross, the device used for measuring the resistance component "a" and capacitative reactance component "−b" of each developer carrying member.
Figure 6:
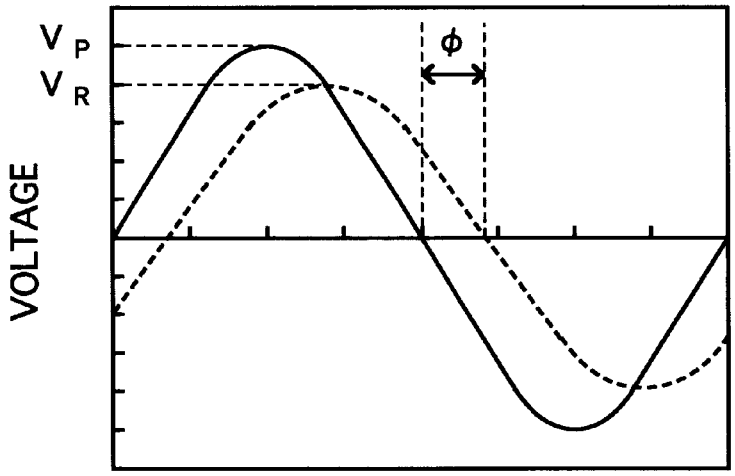
FIG. 6 is a graphical representation of a comparison between a waveform of the AC voltage from the AC voltage source and a waveform of a voltage across the resistance, the waveforms measured by the device of FIG. 5.

As shown in FIG. 5, each of the developer carrying members of Examples 1 to 10 was disposed in contact with an electrode roller 20. An AC voltage source 30 and a resistance 40 were connected across the developer carrying member and the electrode roller, between which an AC voltage was applied by the AC voltage source 30. Measurement was taken on waveforms of the AC voltage thus applied and of a voltage across the resistance 40. As seen in FIG. 6, the waveform of the applied AC voltage, represented by a solid line, had a different peak value and phase from those of the waveform, represented by a broken line, of the voltage across the resistance 40.

As to each of the aforesaid developer carrying members 10, there were determined a peak value $V_P$ of the AC voltage applied by the AC voltage source 30, a peak value $V_R$ of the voltage across the resistance 40, and a phase shift $\phi$ between the waveform of the applied AC voltage and that of the voltage across the resistance 40. On the other hand, a resistance component "a" and a capacitative reactance component "−b" of each developer carrying member 10 were determined by using a resistance value R of the resistance 40 in the following equations:

$$a=(V_P\cdot\cos\phi/V_R-1)\cdot R$$

$$-b=V_P\cdot R\sin\phi/V_R$$

The results are shown in the following Table 1.

Figure 7:
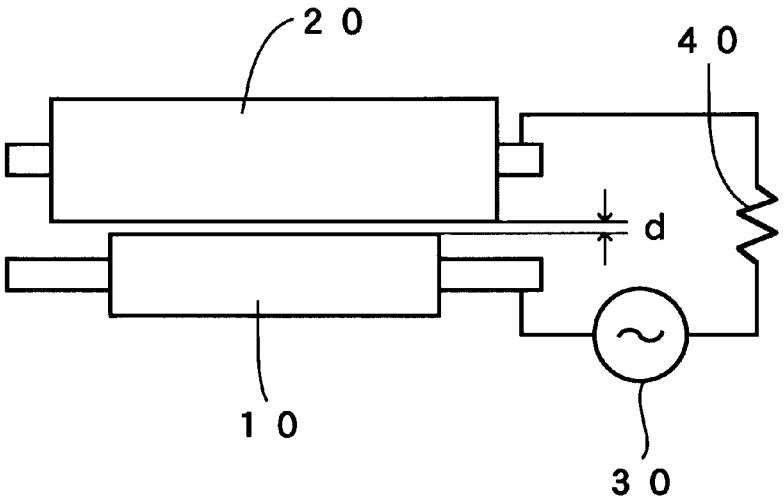
FIG. 7 is a schematic diagram showing an arrangement of the device of FIG. 5 wherein the developer carrying member and the electrode roller define a predetermined gap therebetween and which was used for examination of a relation between a peak value $V_P$ of the AC voltage from the AC voltage source and a peak value $V_R$ of the voltage across the resistance.
Figure 8:
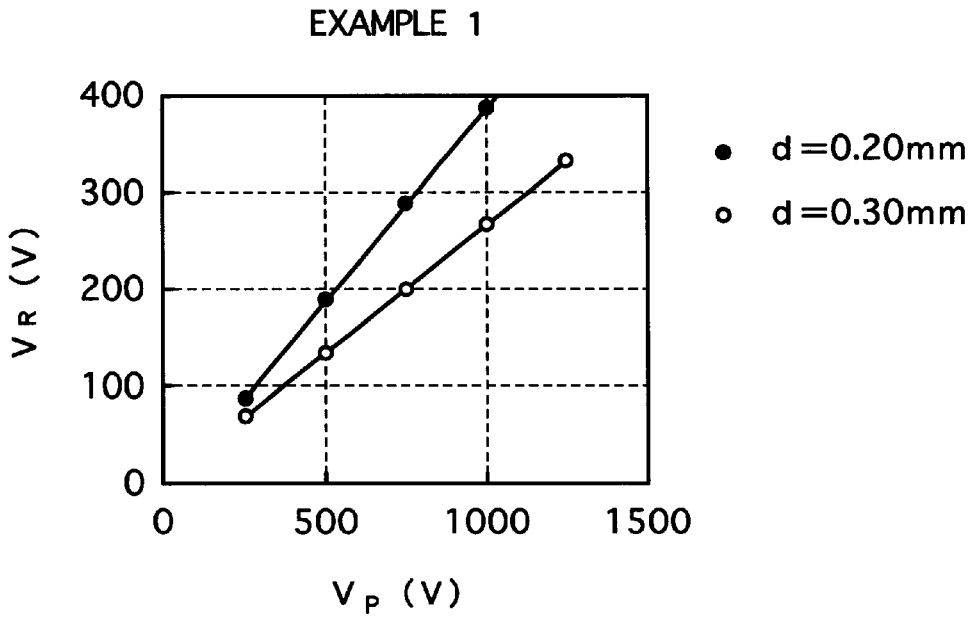
FIG. 8 is a graphical representation of a relation between the peak value $V_P$ of the AC voltage from the AC voltage source and the peak value $V_R$ of the voltage across the resistance, which peak value $V_R$ was measured by the device of FIG. 7 with the gap "d" between a developer carrying member of Example 1 and the electrode roller set to 0.20 mm and 0.30 mm, respectively.
Figure 9:
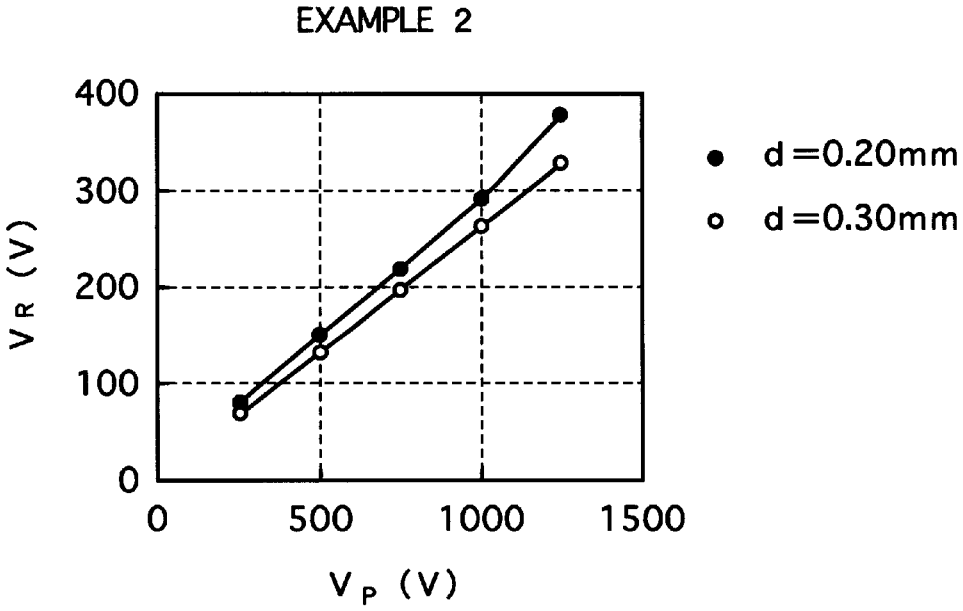
FIG. 9 is a graphical representation of a relation between the peak value $V_P$ of the AC voltage from the AC voltage source and the peak value $V_R$ of the voltage across the resistance, which peak value $V_R$ was measured by the device of FIG. 7 with the gap "d" between a developer carrying member of Example 2 and the electrode roller set to 0.20 mm and 0.30 mm, respectively.
Figure 10:
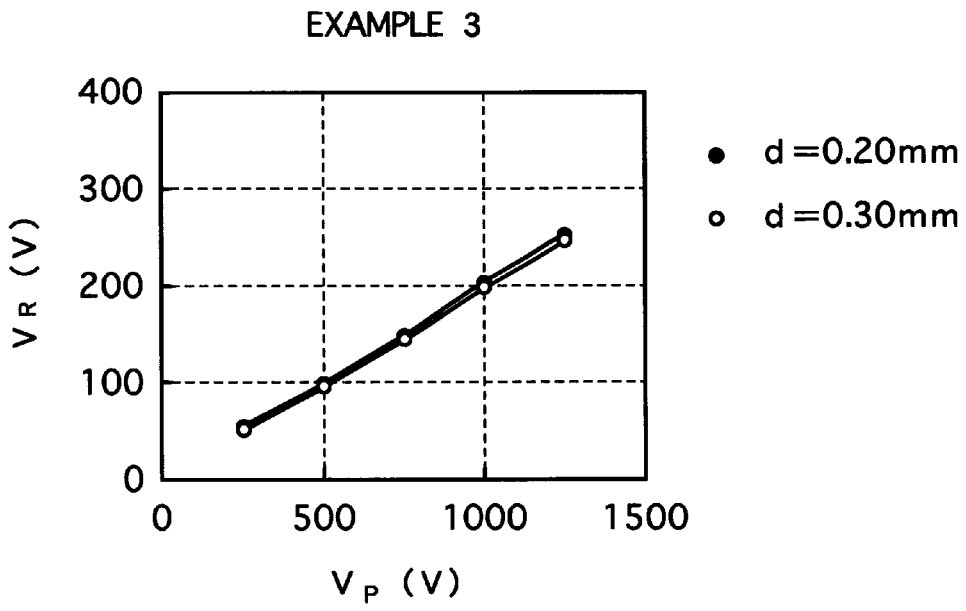
FIG. 10 is a graphical representation of a relation between the peak value $V_P$ of the AC voltage from the AC voltage source and the peak value $V_R$ of the voltage across the resistance, which peak value $V_R$ was measured by the device of FIG. 7 with the gap "d" between a developer carrying member of Example 3 and the electrode roller set to 0.20 mm and 0.30 mm, respectively.
Figure 11:
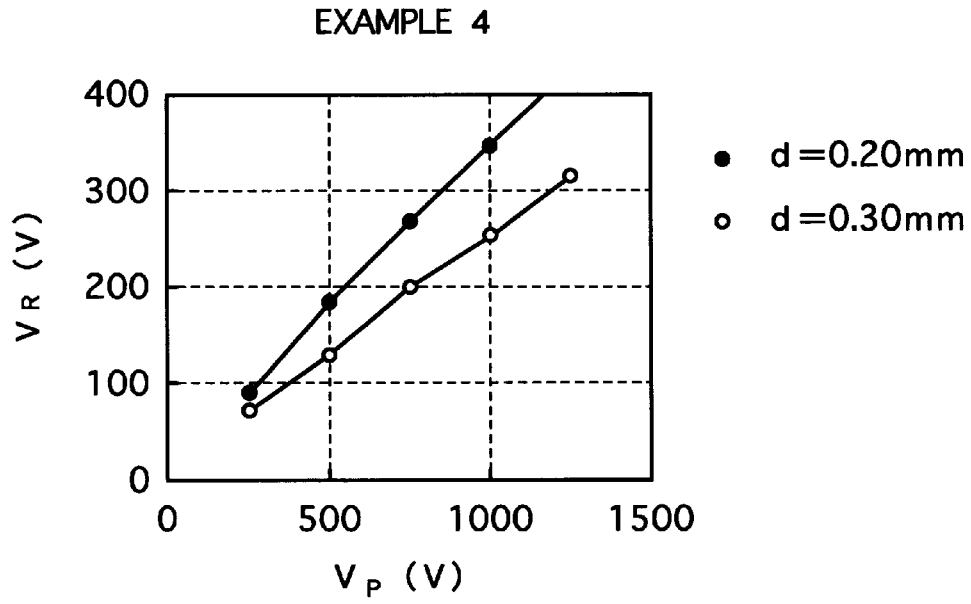
FIG. 11 is a graphical representation of a relation between the peak value $V_P$ of the AC voltage from the AC voltage source and the peak value $V_R$ of the voltage across the resistance, which peak value $V_R$ was measured by the device of FIG. 7 with the gap "d" between a developer carrying member of Example 4 and the electrode roller set to 0.20 mm and 0.30 mm, respectively.
Figure 12:
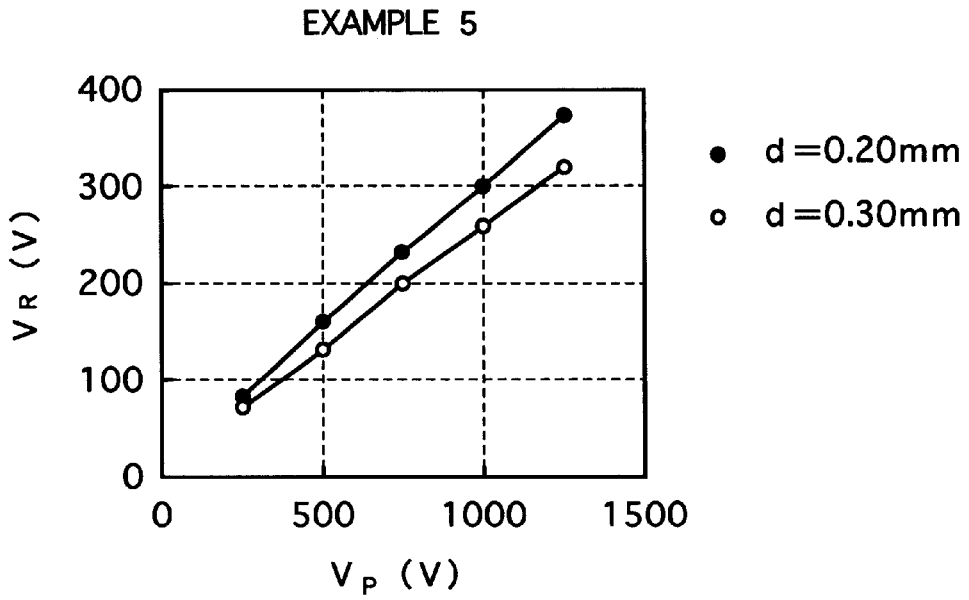
FIG. 12 is a graphical representation of a relation between the peak value $V_P$ of the AC voltage from the AC voltage source and the peak value $V_R$ of the voltage across the resistance, which peak value $V_R$ was measured by the device of FIG. 7 with the gap "d" between a developer carrying member of Example 5 and the electrode roller set to 0.20 mm and 0.30 mm, respectively.
Figure 13:
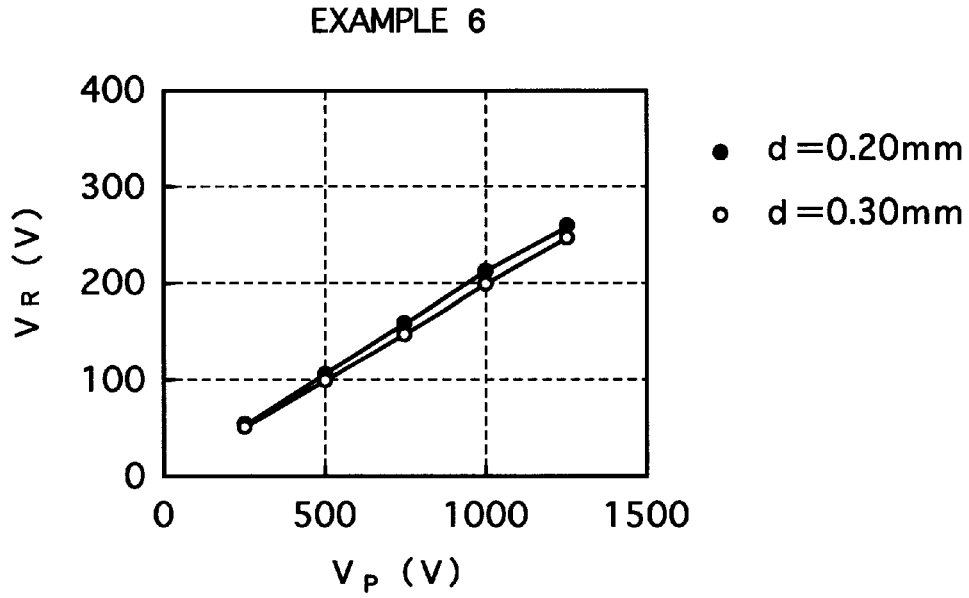
FIG. 13 is a graphical representation of a relation between the peak value $V_P$ of the AC voltage from the AC voltage source and the peak value $V_R$ of the voltage across the resistance, which peak value $V_R$ was measured by the device of FIG. 7 with the gap "d" between a developer carrying member of Example 6 and the electrode roller set to 0.20 mm and 0.30 mm, respectively.
Figure 14:
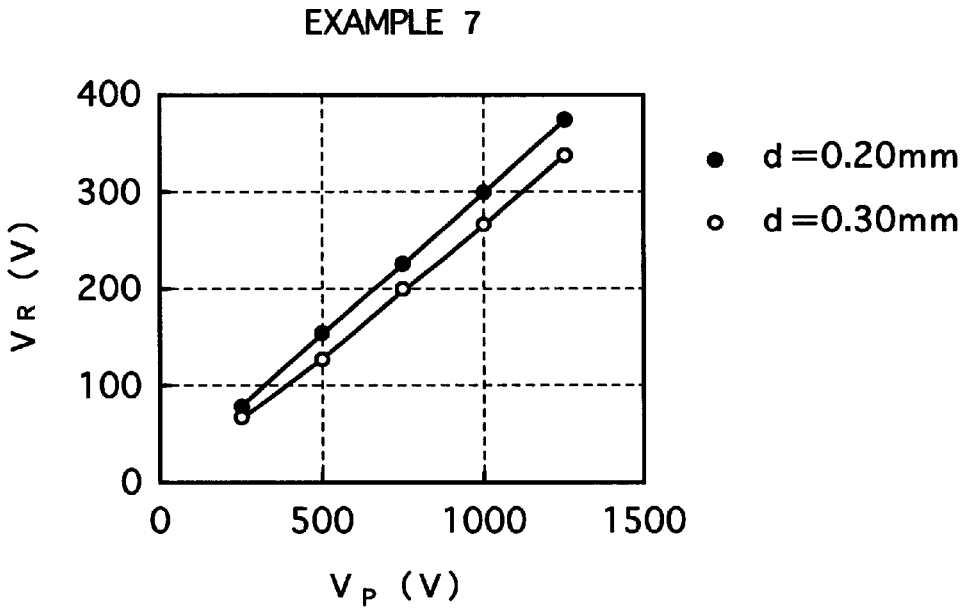
FIG. 14 is a graphical representation of a relation between the peak value $V_P$ of the AC voltage from the AC voltage source and the peak value $V_R$ of the voltage across the resistance, which peak value $V_R$ was measured by the device of FIG. 7 with the gap "d" between a developer carrying member of Example 7 and the electrode roller set to 0.20 mm and 0.30 mm, respectively.
Figure 15:
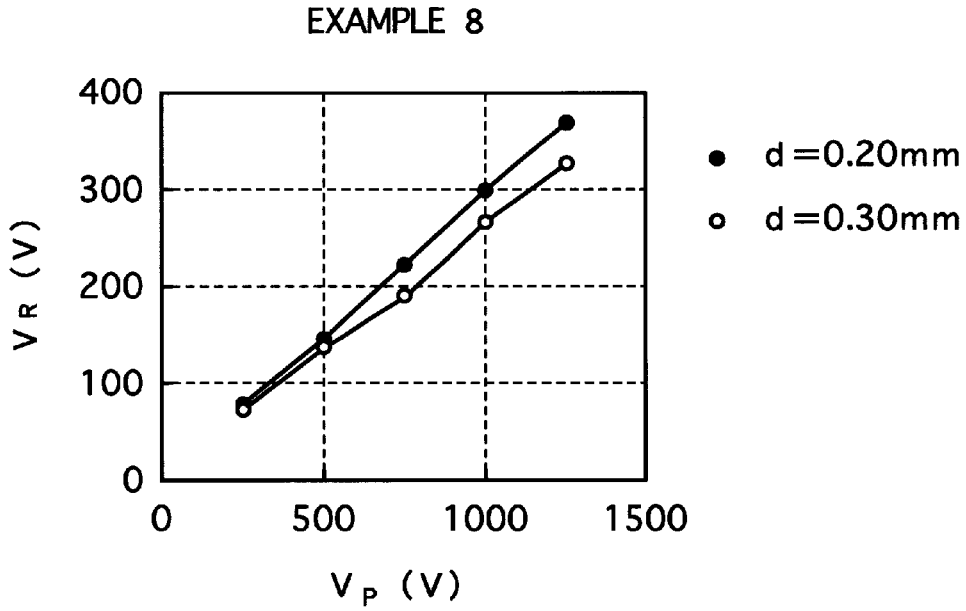
FIG. 15 is a graphical representation of a relation between the peak value $V_P$ of the AC voltage from the AC voltage source and the peak value $V_R$ of the voltage across the resistance, which peak value $V_R$ was measured by the device of FIG. 7 with the gap "d" between a developer carrying member of Example 8 and the electrode roller set to 0.20 mm and 0.30 mm, respectively.
Figure 16:
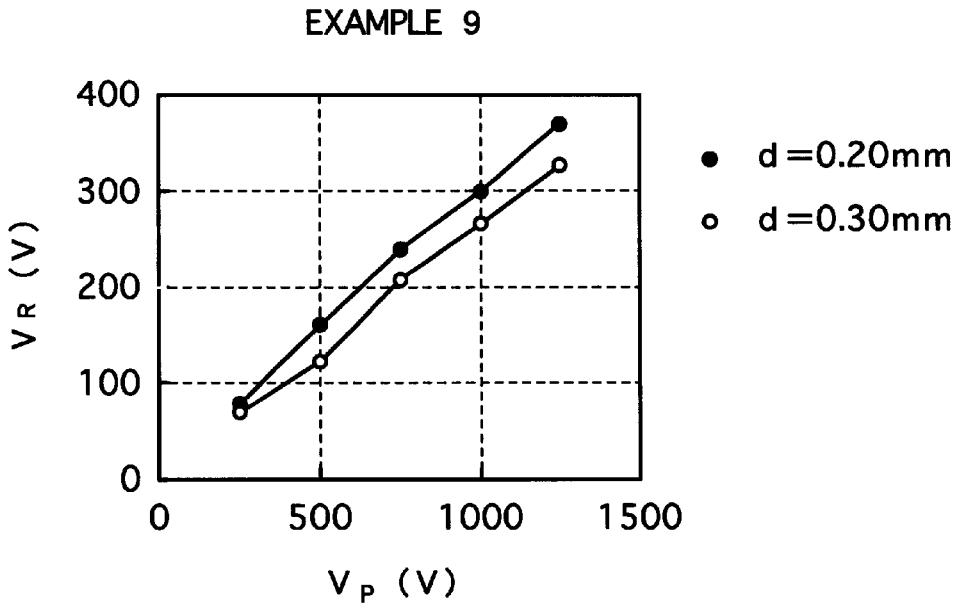
FIG. 16 is a graphical representation of a relation between the peak value $V_P$ of the AC voltage from the AC voltage source and the peak value $V_R$ of the voltage across the resistance, which peak value $V_R$ was measured by the device of FIG. 7 with the gap "d" between a developer carrying member of Example 9 and the electrode roller set to 0.20 mm and 0.30 mm, respectively.
Figure 17:
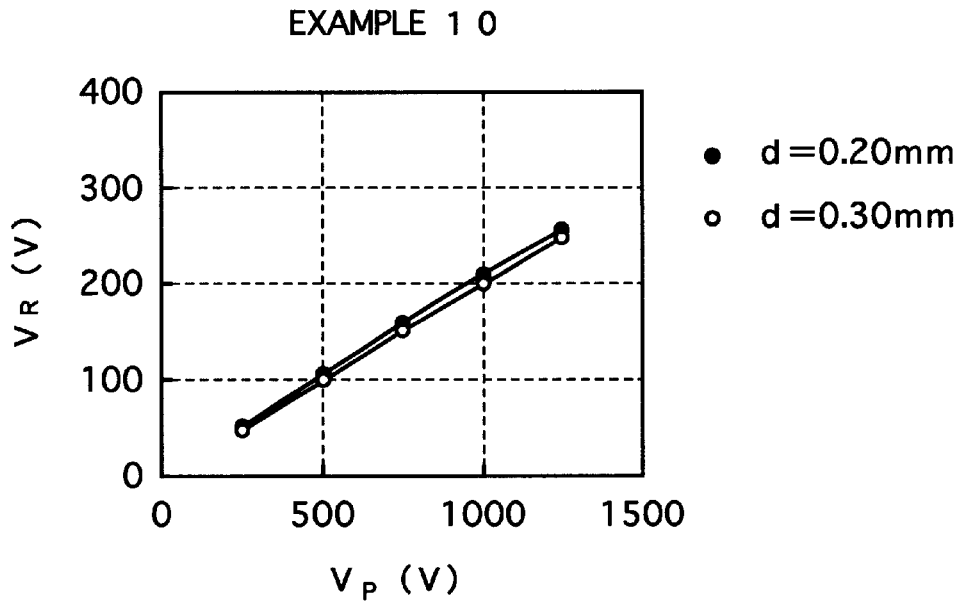
FIG. 17 is a graphical representation of a relation between the peak value $V_P$ of the AC voltage from the AC voltage source and the peak value $V_R$ of the voltage across the resistance, which peak value $V_R$ was measured by the device of FIG. 7 with the gap d between a developer carrying member of Example 10 and the electrode roller set to 0.20 mm and 0.30 mm, respectively.
Figure 18:
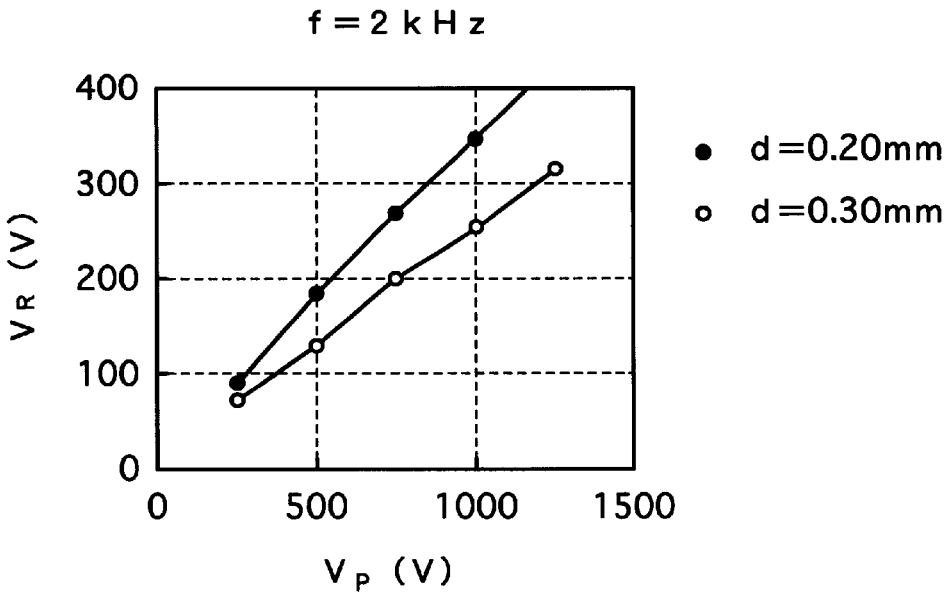
FIG. 18 is graphical representations each showing a relation between the peak value $V_P$ of the AC voltage from the AC voltage source and the peak value $V_R$ of the voltage across the resistance, which peak value $V_R$ was measured by the device of FIG. 7 with the gap "d" between the developer carrying member of Example 4 and the electrode roller set to 0.20 mm and 0.30 mm, respectively, and with the frequency "f" of the AC voltage from the AC voltage source set to 2 kHz and 4 kHz, respectively.
Figure 18:
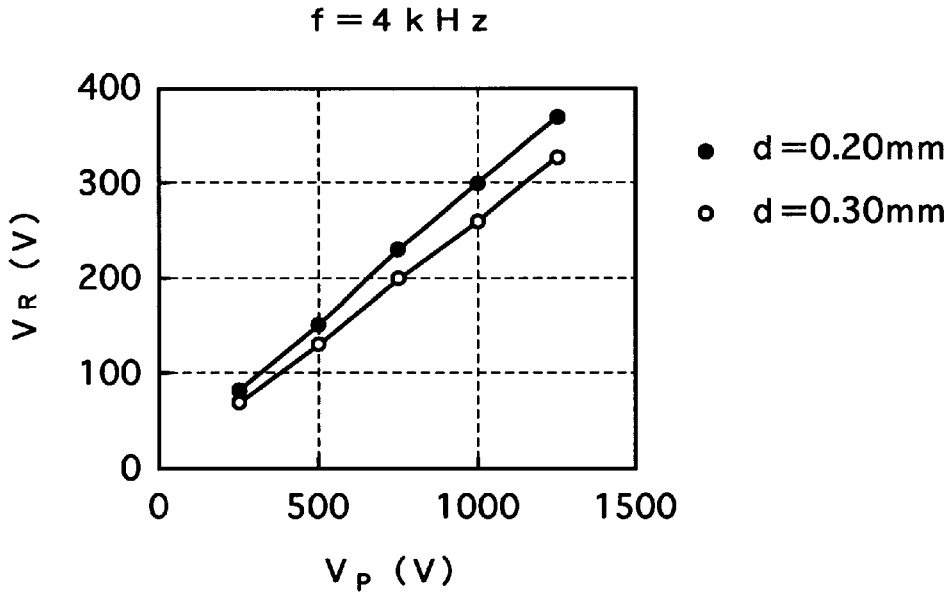
Figure 19:
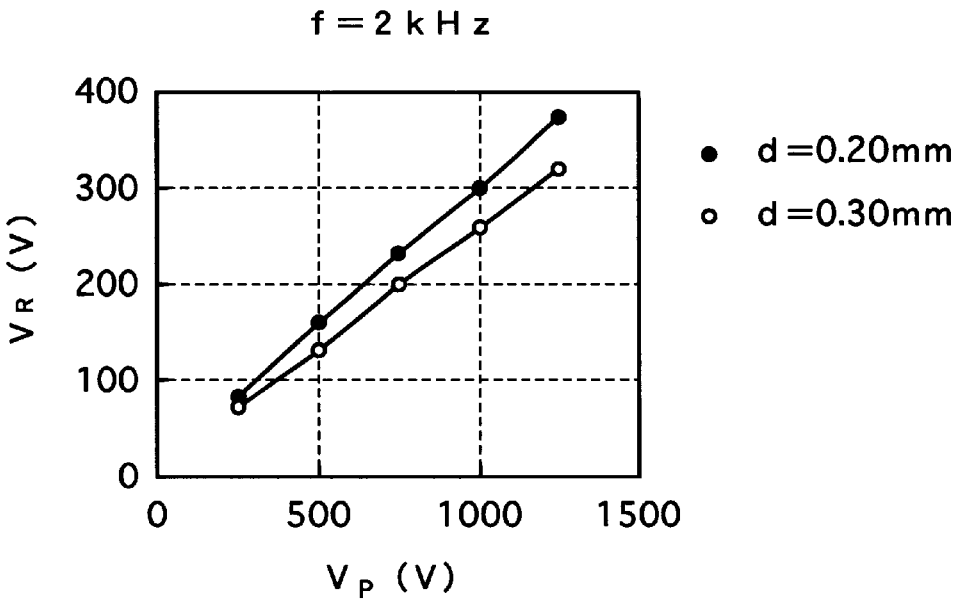
FIG. 19 is graphical representations each showing a relation between the peak value $V_P$ of the AC voltage from the AC voltage source and the peak value $V_R$ of the voltage across the resistance, which peak value $V_R$ was measured by the device of FIG. 7 with the gap "d" between the developer carrying member of Example 5 and the electrode roller set to 0.20 mm and 0.30 mm, respectively, and with the frequency "f" of the AC voltage from the AC voltage source set to 2 kHz and 4 kHz, respectively.
Figure 19:
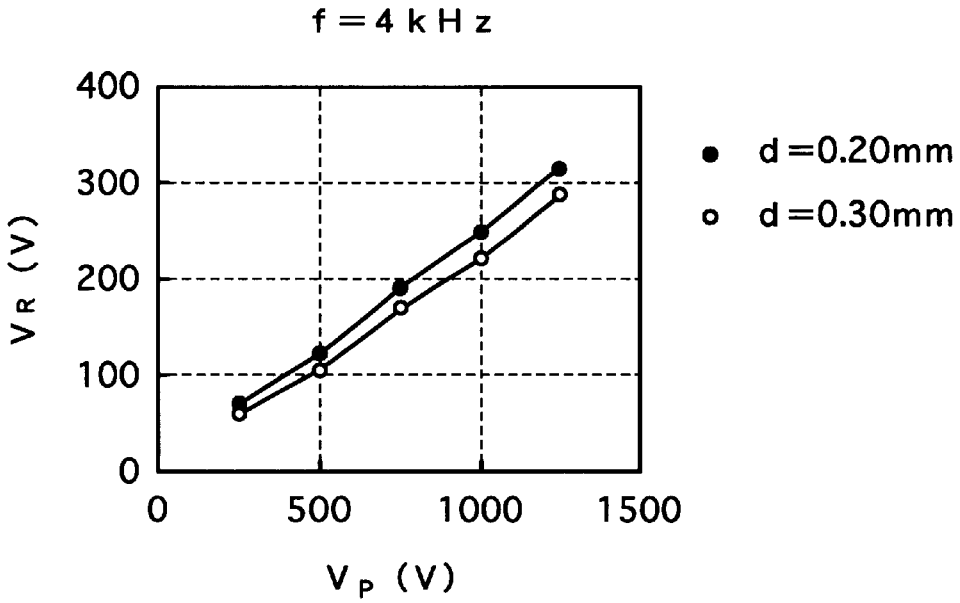
Figure 20:
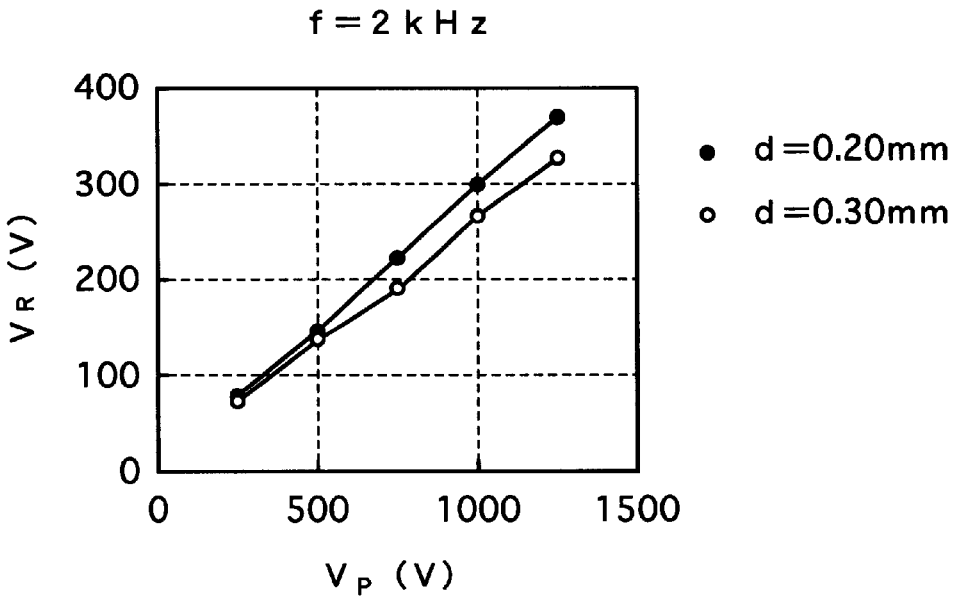
FIG. 20 is graphical representations each showing a relation between the peak value $V_P$ of the AC voltage from the AC voltage source and the peak value $V_R$ of the voltage across the resistance, which peak value $V_R$ was measured by the device of FIG. 7 with the gap "d" between the developer carrying member of Example 8 and the electrode roller set to 0.20 mm and 0.30 mm, respectively, and with the frequency "f" of the AC voltage from the AC voltage source set to 2 kHz and 4 kHz, respectively.
Figure 20:
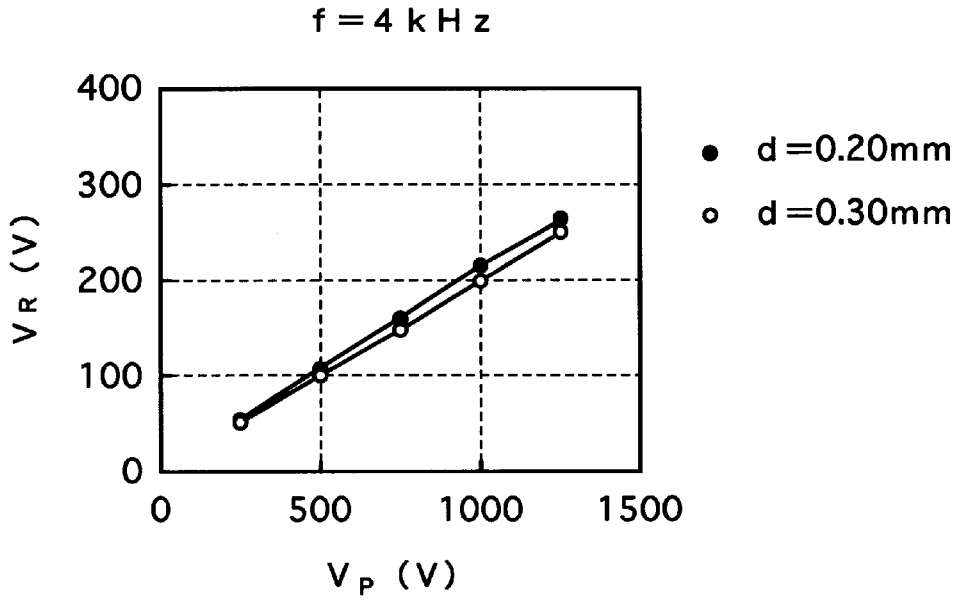

Next, each of the developer carrying members of Examples 1 to 10 was spaced from the electrode roller 20 by a predetermined distance, as shown in FIG. 7.

As to each of the developer carrying members 10 of Examples 1 to 10, variations in the peak value $V_R$ of the voltage across the resistance 40 were examined in association with various peak values $V_P$ of the AC voltage under the following conditions: the gap "d" between each developer carrying member and the electrode roller 20 set to 0.20 mm and 0.30 mm, respectively; and the frequency "d" from the AC voltage source 30 set to 2 kHz. FIGS. 8 to 17 show the results. In these figures, the solid circles ● represent the peak values when the gap "d" between the developer carrying member 10 and the electrode roller 20 was 0.20 mm whereas the hollow circles ○ represent the peak values when the gap "d" therebetween was 0.30 mm.

It is to be noted that in order to ensure that the aforesaid developer carrying member 10 provides a sufficient image density, the voltage across the resistance 40 must be not less than a predetermined level. Furthermore, as the voltage $V_R$ across the resistance 40 associated with the gap "d" of 0.20 mm and the voltage $V_R$ associated with the gap "d" of 0.30 mm present a smaller difference therebetween, reduced are the image density variations due to the varied development gap.

As to each of the developer carrying members 10 of Examples 4, 5 and 8, the variations in the peak value $V_R$ of the voltage across the resistance 40 were examined in association with the various peak values $V_P$ of the AC voltage under the following conditions: the frequency "f" of the AC voltage from the AC voltage source 30 set to 2 kHz and 4 kHz, respectively; the gap "d" between the developer carrying member 10 and the electrode roller 20 set to 0.20 mm and 0.30 mm, respectively. The results are shown in FIGS. 18*a–b* to 20*a–b*. FIGS. 18*a* to 20*a* each show the peak values $V_R$ where the AC voltage had the frequency "f" of 2 kHz whereas FIGS. 18*b* to 20*b* each show the peak values $V_R$ where the AC voltage had the frequency "f" of 4 kHz. In these figures, the solid circles ● represent the peak values $V_R$ when the gap d between the developer carrying member 10 and the electrode roller 20 was 0.20 mm whereas the hollow circles ○ represent the peak values $V_R$ when the gap "d" was 0.30 mm.

According to the results, if the frequency "f" of the AC voltage from the AC voltage source 30 is increased, the varied gap "d" between the developer carrying member 10 and the electrode roller 20 causes smaller variations in the peak value $V_R$ of the voltage across the resistance 40. Thus, the influence of the varied gap Ado is reduced. However, the peak values $V_R$ of the voltage across the resistance 40 decrease so that the produced images have low image densities.

Figure 21:
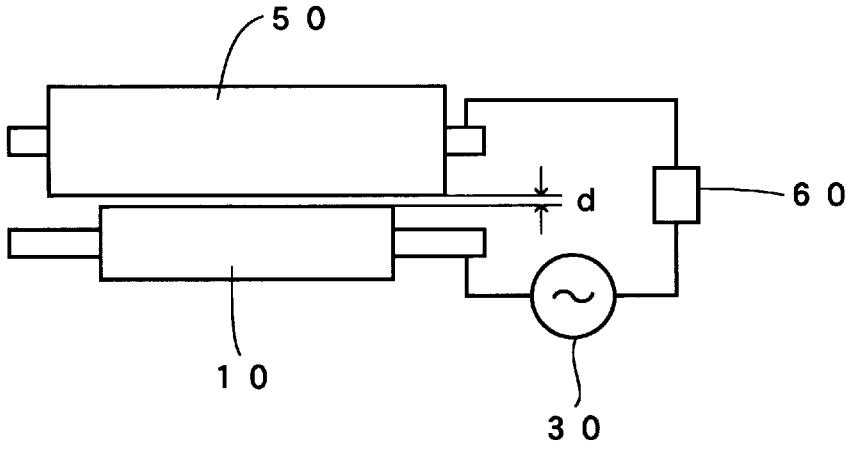
FIG. 21 is a schematic diagram showing a development device using each of the developer carrying members of Examples 1 to 10 hereof for developing the electrostatic latent image formed on the image bearing member.
Figure 22:
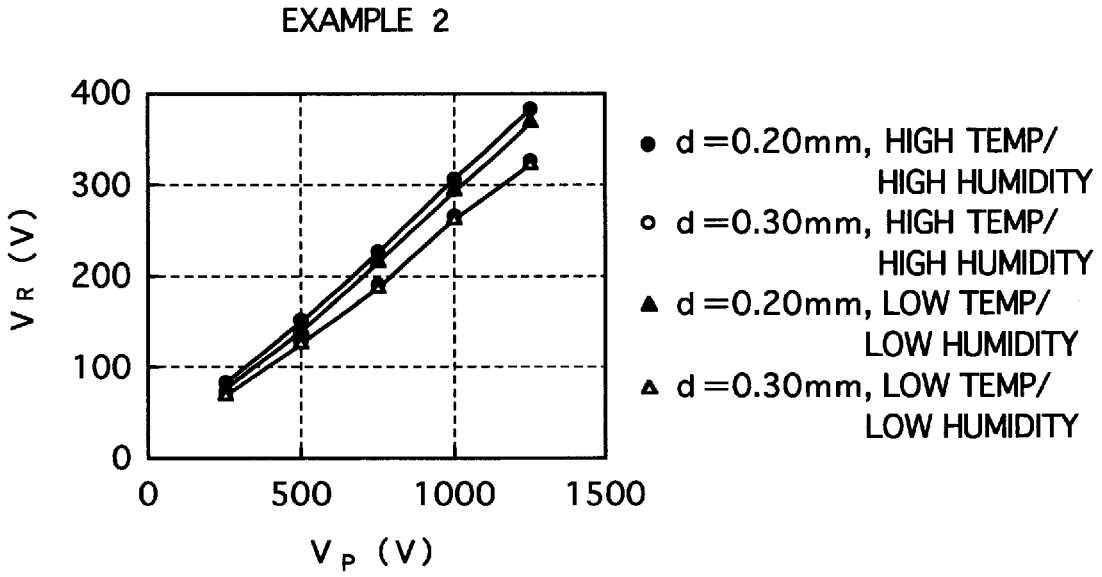
FIG. 22 is a graphical representation of a relation between the peak value $V_P$ of the AC voltage from the AC voltage source and the peak value $V_R$ of the voltage across the resistance, which peak value $V_R$ was measured under high temperature/high humidity conditions and low temperature/low humidity conditions, respectively, by the use of the device of FIG. 7 with the gap "d" between the developer carrying member of Example 2 and the electrode roller set to 0.20 mm and 0.30 mm, respectively.
Figure 23:
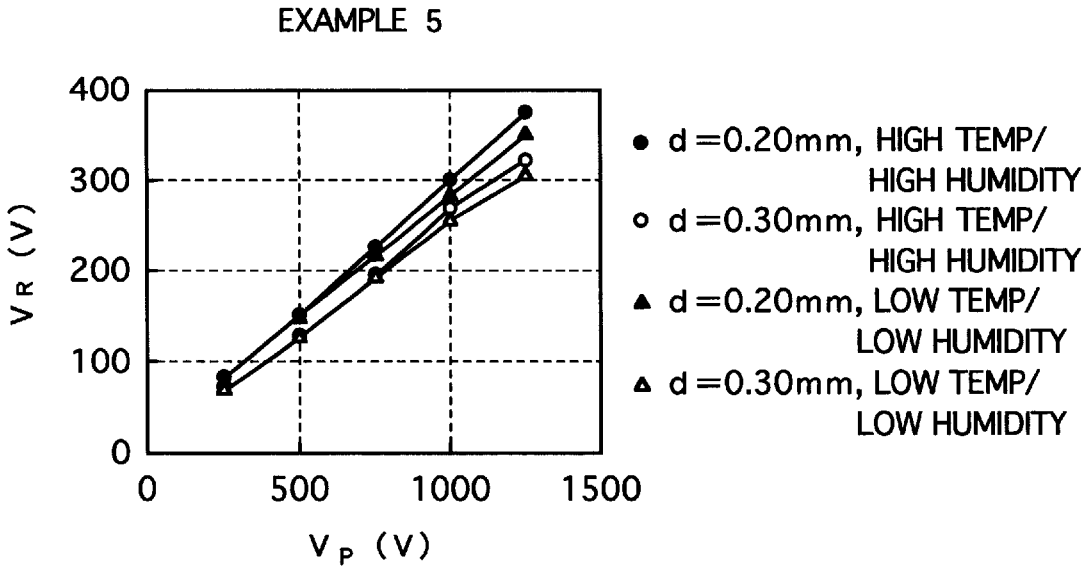
FIG. 23 is a graphical representation of a relation between the peak value $V_P$ of the AC voltage from the AC voltage source and the peak value $V_R$ of the voltage across the resistance, which peak value $V_R$ was measured under high temperature/high humidity conditions and low temperature/low humidity conditions, respectively, by the use of the device of FIG. 7 with the gap "d" between the developer carrying member of Example 5 and the electrode roller set to 0.20 mm and 0.30 mm, respectively.
Figure 24:
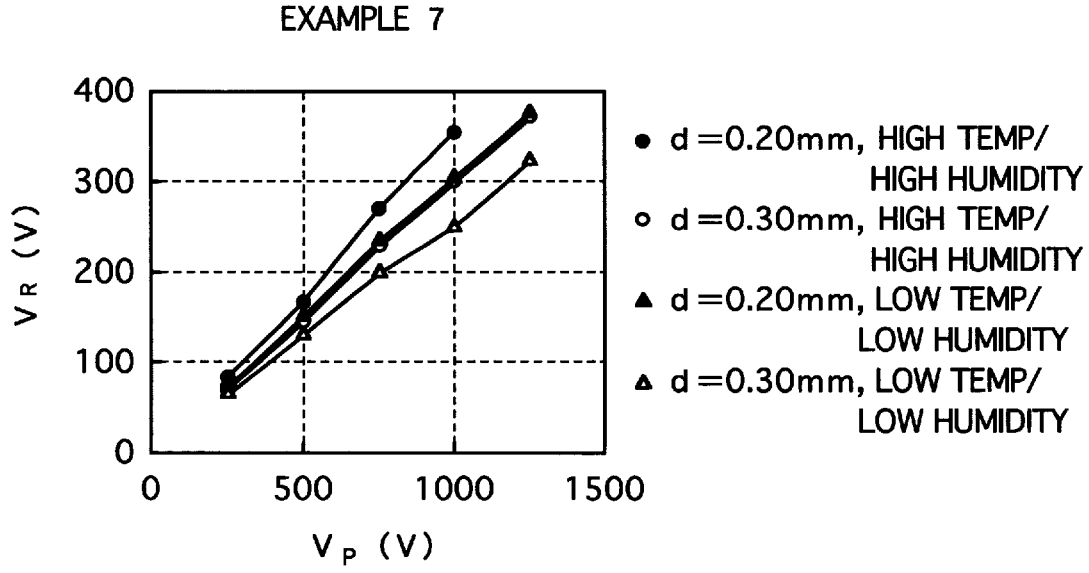
FIG. 24 is a graphical representation of a relation between the peak value $V_P$ of the AC voltage from the AC voltage source and the peak value $V_R$ of the voltage across the resistance, which peak value $V_R$ was measured under high temperature/high humidity conditions and low temperature/low humidity conditions, respectively, by the use of the device of FIG. 7 with the gap "d" do between the developer carrying member of Example 7 and the electrode roller set to 0.20 mm and 0.30 mm, respectively.
Figure 25:
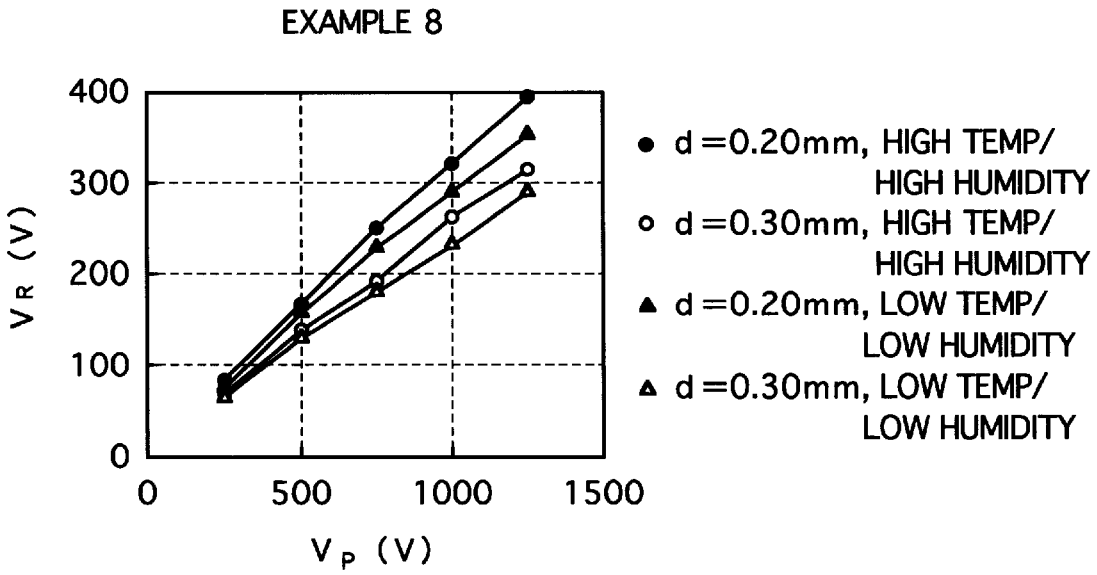
FIG. 25 is a graphical representation of a relation between the peak value $V_P$ of the AC voltage from the AC voltage source and the peak value $V_R$ of the voltage across the resistance, which peak value $V_R$ was measured under high temperature/high humidity conditions and low temperature/low humidity conditions, respectively, by the use of the device of FIG. 7 with the gap "d" between the developer carrying member of Example 8 and the electrode roller set to 0.20 mm and 0.30 mm, respectively.
Figure 26:
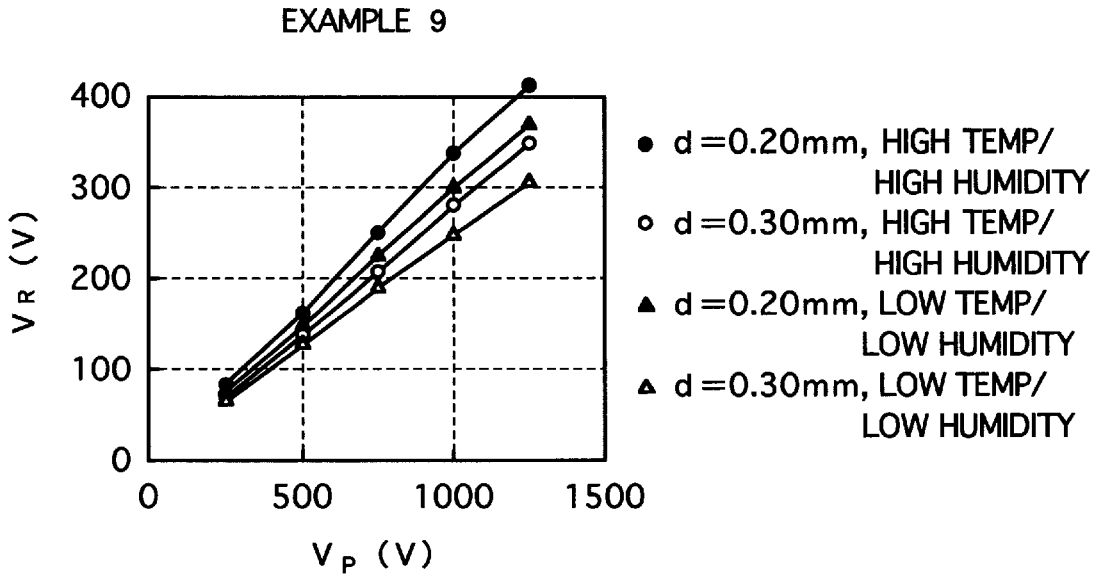
FIG. 26 is a graphical representation of a relation between the peak value $V_P$ of the AC voltage from the AC voltage source and the peak value $V_R$ of the voltage across the resistance, which peak value $V_R$ was measured under high temperature/high humidity conditions and low temperature/low humidity conditions, respectively, by the use of the device of FIG. 7 with the gap "d" between the developer carrying member of Example 9 and the electrode roller set to 0.20 mm and 0.30 mm, respectively.

Next, as shown in FIG. 21, an arrangement was made such that each of the developer carrying members of Examples 1 to 10 opposed an image bearing member 50 across a predetermined gap "d" therebetween while the AC voltage source 30 and a DC voltage source 60 were connected across the developer carrying member 10 and the image bearing member 50. In this arrangement, an AC voltage from the AC voltage source 30 as well as a suitable DC voltage from the DC voltage source 60 were applied to the gap d for effecting a reversal development process under the following conditions: a peak-to-peak value $V_{PP}$ of the AC voltage set to 2 kHz; and the frequency "f" thereof set to 2 kHz and 4 kHz, respectively. Evaluation was made on the stability of the electric field produced between each developer carrying member 10 and the image bearing member 50 and on the density of the produced images. The results are shown in the following Table 1.

As to the field stability, the field strength variations associated with the gap "d" of 0.20 mm between each developer carrying member 10 and the image bearing member 50 and those associated with the gap "d" of 0.30 mm were examined. The results were compared with the variations in strength of the electric field produced between a developer carrying member 10, formed of the conductive roller, and the image bearing member. According to Table 1, a developer carrying member presenting the field strength variations of not more than 90% was considered to be ○ whereas any other developer carrying member was considered to be X. As to the image density, a developer carrying member providing a sufficient image density was considered to be ○, that providing a substantially acceptable image density was considered to be Δ, that failing to provide the sufficient image density was considered to be X.

TABLE 1

| | a | −b | Field Stability | | Image Density | |
|---|---|---|---|---|---|---|
| Example | (Ω) | (Ω) | 2 kHz | 4 kHz | 2 kHz | 4 kHz |
| 1 | $2 \times 10^4$ | $1 \times 10^4$ | x | x | ○ | ○ |
| 2 | $5 \times 10^5$ | $4 \times 10^5$ | ○ | ○ | ○ | ○ |
| 3 | $1 \times 10^6$ | $5 \times 10^6$ | ○ | ○ | x | x |
| 4 | $4 \times 10^4$ | $2 \times 10^5$ | x | ○ | ○ | ○ |
| 5 | $1 \times 10^5$ | $1 \times 10^6$ | ○ | ○ | ○ | ○ |
| 6 | $2 \times 10^5$ | $4 \times 10^6$ | ○ | ○ | x | x |
| 7 | $4 \times 10^5$ | $1 \times 10^5$ | ○ | ○ | ○ | ○ |

TABLE 1-continued

| | a | −b | Field Stability | | Image Density | |
|---|---|---|---|---|---|---|
| Example | (Ω) | (Ω) | 2 kHz | 4 kHz | 2 kHz | 4 kHz |
| 8 | $1 \times 10^6$ | $5 \times 10^5$ | ○ | ○ | ○ | Δ |
| 9 | $3 \times 10^5$ | $2 \times 10^5$ | ○ | ○ | ○ | ○ |
| 10 | $3 \times 10^6$ | $5 \times 10^5$ | ○ | ○ | x | x |

Where the AC voltage having the frequency "f" of 2 kHz was applied by the AC voltage source 30, the developer carrying members 10 of Examples 2, 5 and 7 to 9 satisfied of the aforementioned conditions 1 to 3 of the invention. Where the AC voltage having the frequency of 4 kHz was applied by the AC voltage source 30, the developer members 10 of Examples 2, 4, 5, and 7 to 9 satisfied any one of the aforementioned conditions 1 to 3 of the invention.

If any one of the aforementioned conditions 1 to 3 of the invention was satisfied, the electric field applied between the developer carrying member 10 and the image bearing member 50 was reduced in strength variations despite the varied gap "d" therebetween. Accordingly, images stable and sufficient in image density were produced.

Next, a test was conducted by using each of the developer carrying members 10 of Examples 2, 5 and 7 to 9 in the device shown in FIG. 7. In the test, the AC voltage at the frequency "f" of 2 kHz was applied by the AC voltage source 30 to the gap "d" between each developer carrying member 10 and the electrode roller 20, the gap "d" set to 0.20 mm and 0.30 mm. The test examined the variations in the peak value $V_R$ of the voltage across the resistance 40 in association with the various peak values $V_P$ of the AC voltage under high temperature/high humidity conditions of 30° C. in temperature and 85% in humidity and low temperature/low humidity conditions of 10° C. in temperature and 15% in humidity. The results are shown in FIGS. 22 to 26, wherein the solid circles ● represent the peak values $V_R$ associated with the gap "d" of 0.20 mm under the high temperature/high humidity conditions whereas the hollow circles ● represent the peak values $V_R$ associated with the gap "d" of 0.30 mm under the high temperature/high humidity conditions. On the other hand, the solid triangles ▲ represent the peak values $V_R$ associated with the gap "d" of 0.20 mm under the low temperature/low humidity conditions whereas the hollow triangles ▲ represent the peak values $V_R$ associated with the gap"d " of 0.30 mm under the low temperature/low humidity conditions.

According to the results, the developer carrying members 10 of Examples 2 and 5 achieved smaller variations in the peak value $V_R$ of the voltage across the resistance 40 at the varied temperatures and humidities, as compared with the developer carrying members 10 of Examples 7 to 9. The developer carrying members 10 of Examples 2 and 5 included the resilient layer 12 formed of the electron conductive material containing silicone rubber or EPDM rubber with carbon black added thereto, whereas those of Examples 7 to 9 included the resilient layer 12 formed of the ion conductive material containing urethane rubber or epichlorohydrin rubber.

Thus, the developer carrying member 10 wherein the resilient layer 12 is formed of the electron conductive material ensures that the images with stable image density are produced under the varied temperatures, humidities and the like.

In each of the developer carrying members 10 of Examples 1 to 10, the thickness of the resilient layer 12 was changed to examine a variation thereof under the aforementioned high temperature/high humidity conditions and low temperature/low humidity conditions. With increase in the thickness thereof, the resilient layers 12 suffered greater thickness variations due to the environmental changes. This also resulted in the variation of the gap "d" between the developer carrying member 10 and the image bearing member 50 and hence, the produced images were varied in image density.

Where the resilient layer 12 in each of the above developer carrying members 10 had a thickness of not more than 2 mm, the resilient layer 12 presented the thickness variations of not more than 50 $\mu$m in the environmental changes between the aforementioned high temperature/high humidity conditions and low temperature/low humidity conditions. Thus, the image density variations due to the environmental changes were decreased.

EXAMPLE 11

Example 11 used a developer carrying member 10 having a resistance component "a" of $5\times10^5$ Ω and a capacitative reactance component "–b" of $4\times10^5$ Ω. As shown in FIG. 21, an arrangement was made such that the developer carrying member 10 opposed the image bearing member 50 across a predetermined gap "d" therebetween while the AC voltage source 30 and the DC voltage source 60 were connected across the developer carrying member 10 and the image bearing member 50. In this arrangement, the reversal development process was performed by applying, between the developer carrying member 10 and the image bearing member 50, an AC voltage from the AC voltage source 30 and a DC voltage $V_{DC}$ from the DC voltage source 60, thereby producing a halftone image with a target density of about 0.6. The AC voltage had a rectangular waveform, a frequency "f" of 2 kHz and a period ratio (duty ratio) of 50%, the period during which the voltage effected an electric field in a toner leading direction toward the image bearing member 50.

Figure 27:
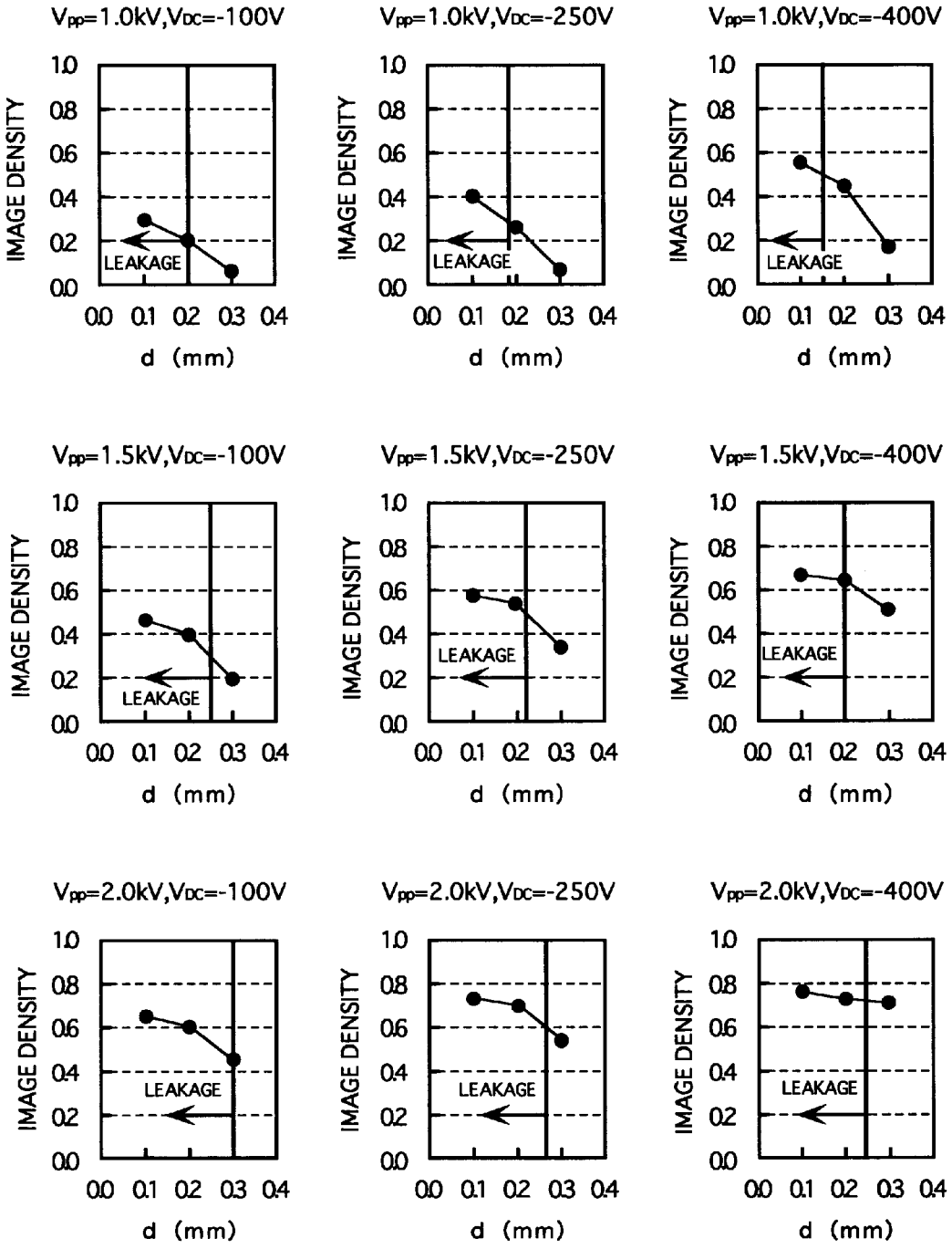
FIG. 27 is graphical representations each showing the variations of densities of images produced by the development device of FIG. 21 performing a reversal development process under the following conditions: the gap "d" between a developer carrying member of Example 11 and the image bearing member set to 0.1 mm, 0.2 mm and 0.3 mm, respectively; a peak-to-peak value $V_{PP}$ of the AC voltage from the AC voltage source set to 1.0 kV, 1.5 kV and 2.0 kV, respectively; a DC voltage $V_{DC}$ from a DC voltage source set to −100 V, −250 V and −400 V, respectively.

The reversal development process was performed under the following conditions: a potential $V_o$ of −800 V at the non-image area of the image bearing member 50; a potential $V_i$ of −50 V at an image area thereof; the gap"d" between the developer carrying member 10 and the image bearing member 50 set to 0.1 mm, 0.2 mm and 0.3 mm, respectively; the peak-to-peak value $V_{PP}$ of the AC voltage from the AC voltage source 30 set to 1.0 kV, 1.5 kV and 2.0 kV, respectively; and the DC voltage $V_{DC}$ from the DC voltage source 60 set to −100 V, −250 V and −400 V, respectively. Variations in the image density of the produced images were examined. The results are shown in FIG. 27 in which an occurrence of leakage means a local insulation breakdown produced between the non-image area of the image bearing member 50 and the developer carrying member 10.

According to the results, the increased peak-to-peak value $V_{PP}$ of the AC voltage applied by the Ac voltage source 30 resulted in the increased density of the produced images and in the decreased density variations due to the varied gap "d" between the developer carrying member 10 and the image bearing member 50. Unfortunately, however, the leakage tended to occur between the non-image area of the image bearing member 50 and the developer carrying member 10, producing the local insulation breakdown therebetween. Consequently, spot-like toner adhesion to the non-image area resulted.

On the other hand, the increased absolute value of the DC voltage $V_{DC}$ applied by the DC voltage source 60 resulted in the increased density of the produced images and in the decreased leakage produced between the non-image area of the image bearing member 50 and the developer carrying member 10.

Hence, in order to decrease the image density variations caused by the varied gap "d" between the developer carrying member 10 and the image bearing member 50 and to suppress the occurrence of leakage between the non-image area of the image bearing member 50 and the developer carrying member 10, it was preferred to increase the peak-to-peak value $V_{PP}$ of the AC voltage from the AC voltage source 30 and the absolute value of the DC voltage $V_{DC}$ from the DC voltage source 60.

However, the increased peak-to-peak value $V_{PP}$ of the AC voltage from the AC voltage source 30 in combination with the increased DC voltage $V_{DC}$ from the DC voltage source 60 resulted in a great increase in the density of the produced images. When the peak-to-peak value $V_{PP}$ of the AC voltage was at 2.0 kV and the absolute value of the DC voltage $V_{DC}$ was at −400 V, the produced image suffered an excessive increase in image density.

Next, the AC voltage applied by the AC voltage source 30 was varied in its duty ratio to 50%, 35% and 25% for adjustment of the density of the produced images.

Figure 28:
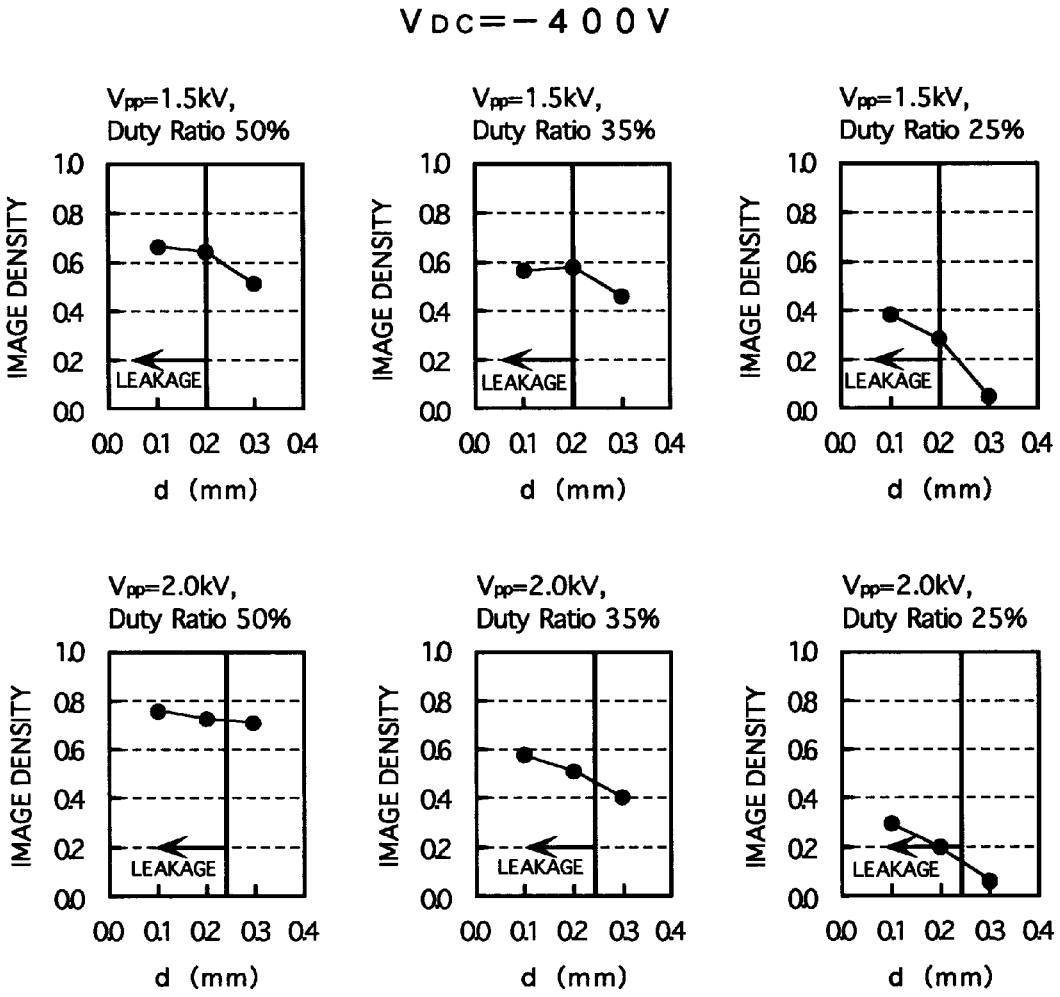
FIG. 28 is graphical representations each showing the density variations of images produced by the development device of FIG. 21 performing the reversal development process under the following conditions: the DC voltage $V_{DC}$ of −400 V applied between the developer carrying member of Example 11 and the image bearing member; the peak-to-peak value of the AC voltage from the AC voltage source set to 1.5 kV and to 2.0 kV, respectively; a duty ratio of the AC voltage set to 50%, 35% and 25%, respectively; the gap "d" between the developer carrying member and the image bearing member set to 0.1 mm, 0.2 mm and 0.3 mm, respectively.
Figure 29:
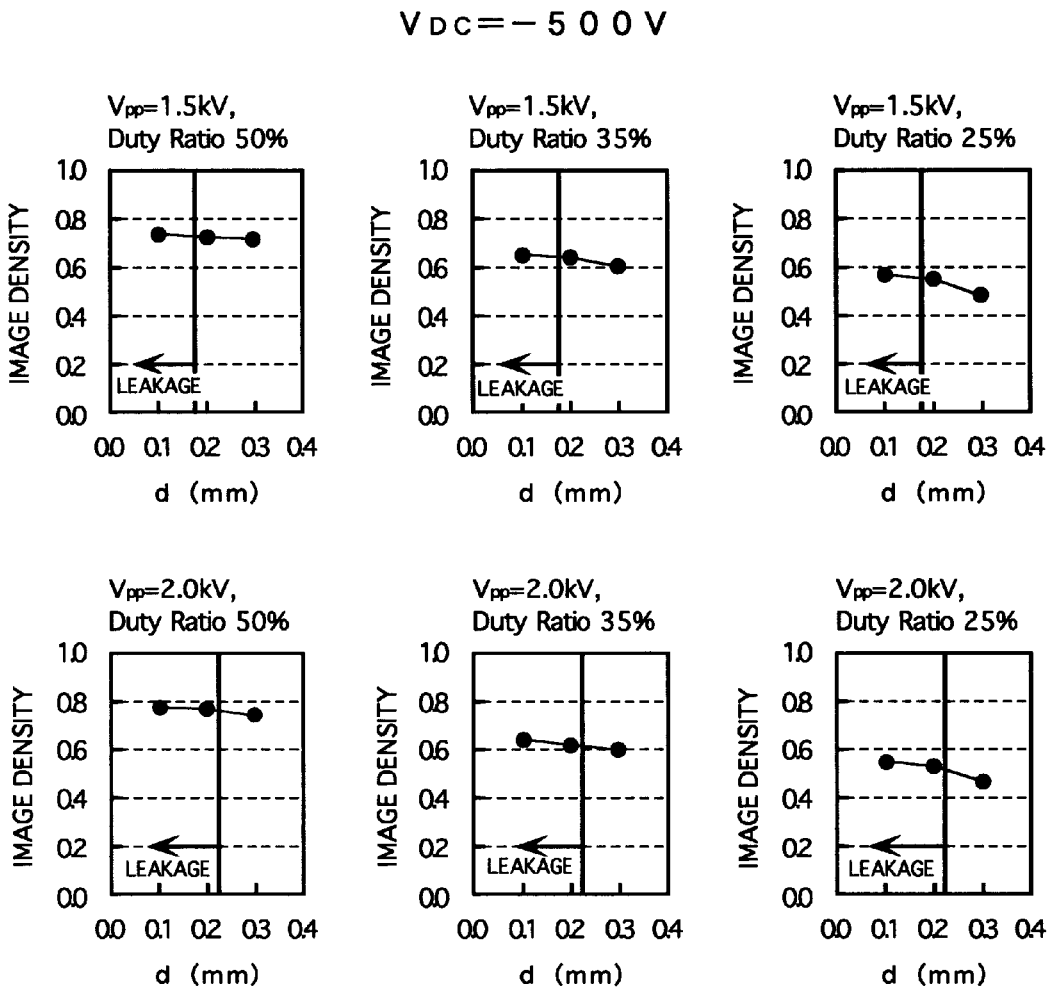
FIG. 29 is graphical representations each showing the density variations of images produced by the development device of FIG. 21 performing the reversal development process under the following conditions: a DC voltage $V_{DC}$ of −500 V applied between the developer carrying member of Example 11 and the image bearing member; the peak-to-peak value of the AC voltage from the AC voltage source set to 1.5 kV and to 2.0 kV, respectively; the duty ratio of the AC voltage set to 50%, 35% and 25%, respectively; and the gap "d" between the developer carrying member and the image bearing member set to 0.1 mm, 0.2 mm and 0.3 mm, respectively.
Figure 30:
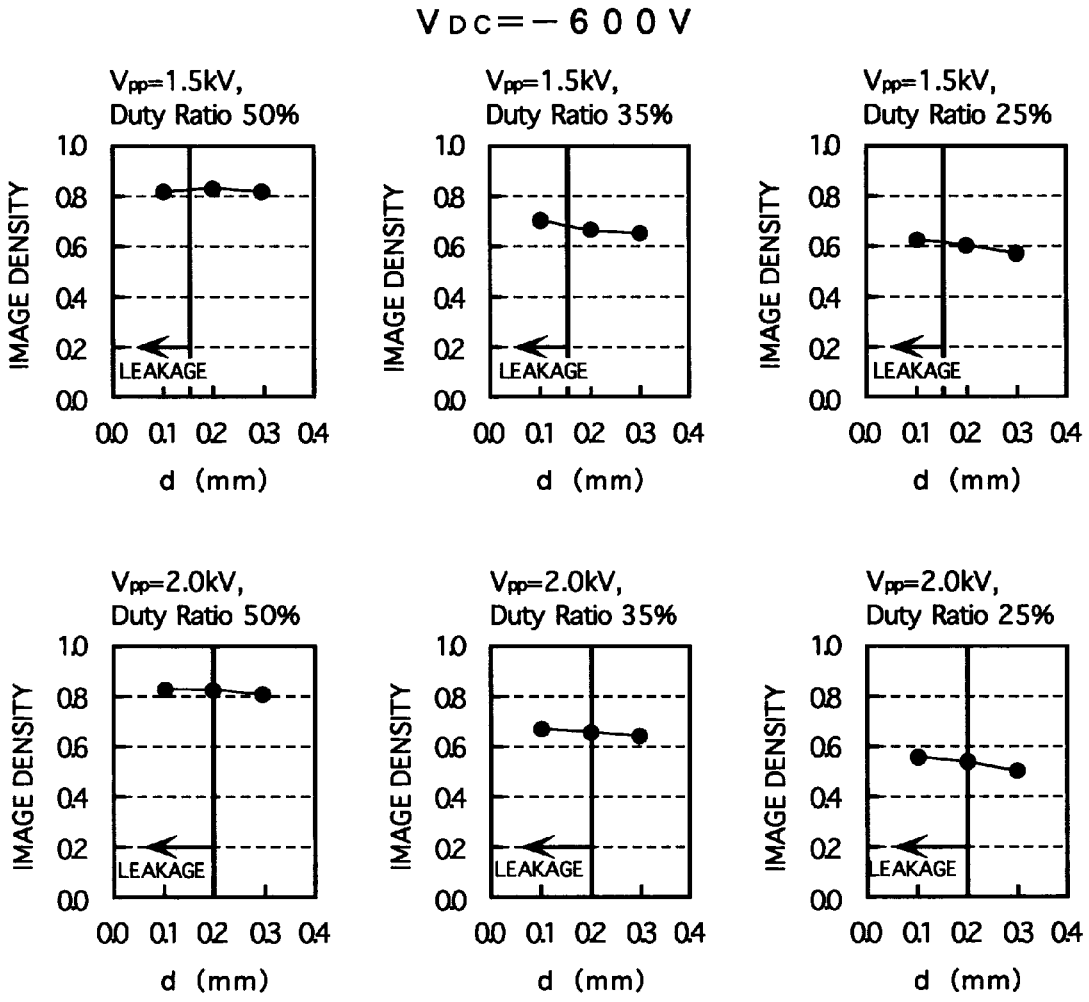
FIG. 30 is graphical representations each showing the density variations of images produced by the development device of FIG. 21 performing the reversal development process under the following conditions: a DC voltage $V_{DC}$ of −600 V applied between the developer carrying member of Example 11 and the image bearing member; the peak-to-peak value of the AC voltage from the AC voltage source set to 1.5 kV and to 2.0 kV, respectively; the duty ratio of the AC voltage set to 50%, 35% and 25%, respectively: and the gap "d" between the developer carrying member and the image bearing member set to 0.1 mm, 0.2 mm and 0.3 mm, respectively.

The reversal development process was performed under the following conditions: the gap "d" between the developer carrying member 10 and the image bearing member 50 set to 0.1 mm, 0.2 mm and 0.3 mm, respectively; the peak-to-peak value $V_{PP}$ of the AC voltage from the AC voltage source 30 set to 1.5 kV and 2.0 kV, respectively; and the DC voltage $V_{DC}$ from the DC voltage source 60 set to −400 V, −500 V and −600 V, respectively. The densities of the produced images were measured to determine the density variations. FIG. 28 shows the densities of the images produced with the DC voltage $V_{DC}$ set to −400 V; FIG. 29 shows the densities of the images produced with the DC voltage $V_{DC}$ set to −500 V; and FIG. 30 shows the densities of the images produced with the DC voltage $V_{DC}$ set to −600 V.

According to the results, where the DC voltage Vc had the low absolute value of −400 V, the decreased duty ratio of the AC voltage increased the image density variations due to the varied gap "d" between the developer carrying member 10 and the image bearing member 50. Where, on the other hand, the DC voltage $V_{DC}$ was increased in the absolute value thereof, the image density variations due to the varied gap "d" were reduced despite the decreased duty ratio of the AC voltage. In addition, the occurrence of leakage between the non-image area of the image bearing member 50 and the developer carrying member 10 was suppressed.

Unfortunately, with increase in the absolute value of the DC voltage $V_{DC}$, the leakage was more likely to occur between the image area of the image bearing member 50 and the developer carrying member 10. Where the DC voltage $V_{DC}$ was at −600 V, the occurrence of leakage was observed between the image area of the image bearing member 50 and the developer carrying member 10 when the AC voltage with the peak-to-peak value $V_{PP}$ of 1.5 kV was applied to the gap "d" of 0.21 mm between the developer carrying member 10 and the image bearing member 50 and when the AC voltage with the peak-to-peak value $V_{PP}$ of 2.0 kV was applied to the gap "d" of 0.25 mm.

Where the DC voltage was at −500 V, on the other hand, substantially the same gap "d" was associated with the onset of leakages occurring between the image area of the image bearing member 50 and the developer carrying member 10 and between the non-image area thereof and the developer carrying member 10.

In order to ensure that the image density variations due to the varied gap "d" do are decreased and that images with a suitable density are produced, it was preferred to limit the peak-to-peak value $V_{PP}$ of the AC voltage from the AC voltage source 30 within the range of between 1.5 kV and 2.0 kV and to decrease the ratio (duty ratio) of the period during which the AC voltage effected the electric field in the toner leading direction toward the image bearing member 50. Incidentally, the DC voltage $V_{DC}$ from the DC voltage source 60 may be set to a suitable value for adjustment of the density of the produced images and suppression of the leakage, with consideration given to the potential $V_o$ of the non-image area and that $V_i$ of the image area of the image bearing member 50.

Next, a test was conducted on the developer carrying member 10 of Example 11 having the resistance component "a" of $5\times10^5$ Ω and the capacitative reactance component "−b" of $4\times10^5$ Ω and a developer carrying member 10 of Comparative Example 1 having a resistance component "a" of $2\times10^4$ Ω and a capacitative reactance component "−b" of $1\times10^4$ Ω.

Figure 31:
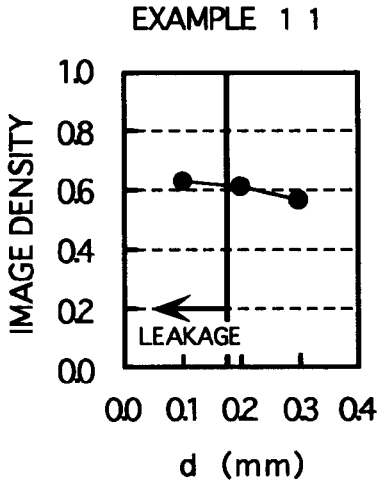
FIG. 31 is graphical representations each showing the density variations of images produced by the development device of FIG. 21 using the developer carrying member of Example 11 and that of Comparative Example 1, the development device wherein the gap "d" between the developer carrying member and the image bearing member was set to 0.1 mm, 0.2 mm and 0.3 mm, respectively.
Figure 31:
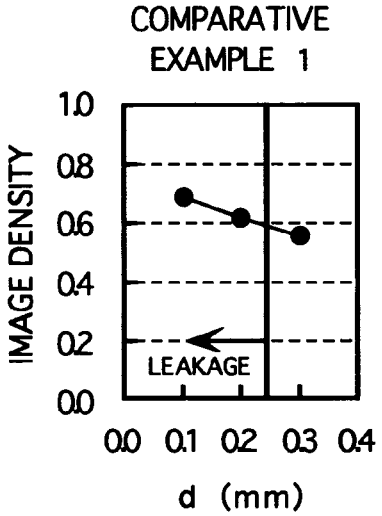

The reversal development process was performed by applying between each developer carrying member 10 and the image bearing member 50 an AC voltage from the AC voltage source 30 and a DC voltage $V_{DC}$ from the DC voltage source 60. The image density variations were examined under the following conditions: 2 kHz in the frequency "f" of the AC voltage; 1.7 kV in the peak-to-peak value $V_{PP}$ of the AC voltage; 30% in the duty ratio of the AC voltage; −500 V in the DC voltage $V_{DC}$; and the gap "d" between the developer carrying member 10 and the image bearing member 50 set to 0.1 mm, 0.2 mm and 0.3 mm, respectively. FIG. 31*a* shows the densities of the images produced by using the developer carrying member 10 of Example 11 whereas FIG. 31*b* shows the densities of the images produced by using the developer carrying member 10 of Comparative Example 1.

It is to be noted that any one of the aforementioned conditions of the invention was satisfied by the use of the developer carrying member 10 of Example 11 but none of the conditions was satisfied by the use of the developer carrying member 10 of Comparative Example 1.

The following fact was found from a comparison between the images produced by the use of the developer carrying member 10 of Example 11 and those produced by the use of the developer carrying member 10 of Comparative Example 1. The developer carrying member 10 of Example 11 is effective to reduce the image density variations due to the varied gap "d " between the developer carrying member 10 and the image bearing member 50 and to suppress the leakage produced between the image bearing member 50 and the developer carrying member 10.

In the above test, the AC voltage from the AC voltage source 30 had the frequency "f" of 2 kHz. Where the frequency "f" was not more than 1 kHz, the produced image tended to suffer fogs in a non-image portion thereof. Where the frequency "f" was not less than 5 kHz, the produced image suffered a poor density.

Hence, it was found that the AC voltage from the AC voltage source 30 preferably has a frequency "f" in the range of between 1 kHz and 5 kHz.

Although the present invention has been fully described by way of examples hereof, it is to be noted that various changes and modifications will be apparent to those skilled in the art. Therefore, unless otherwise such changes and modifications depart from the scope of the present invention, they should be construed as being included therein.

What is claimed is:

1. A development device for developing an electrostatic latent image formed on an image bearing member comprising:

a developer carrying member opposing the image bearing member across a predetermined gap therebetween and holding a toner thereon; and a power unit for applying an alternating voltage between the image bearing member and the developer carrying member, the development device satisfying relations:

$$a \leqq 5\times10^9/f, \text{ and } 5\times10^8/f \leqq -b \leqq 5\times10_9/f$$

where a (Ω) denotes a resistance component of an impedance of said developer carrying member, −b (Ω) denotes a capacitative reactance component of the impedance thereof, and f (Hz) denotes a frequency of said alternating voltage.

2. A development device as claimed in claim 1, wherein said developer carrying member comprises a conductive roller and a resilient layer formed thereon.

3. A development device as claimed in claim 2, wherein said resilient layer has a thickness of 2 mm or less.

4. A development device as claimed in claim 2, wherein said resilient layer is formed of an electron conductive material.

5. A development device as claimed in claim 1, wherein said power unit applies the alternating voltage and a direct voltage between the image bearing member and the developer carrying member and satisfies relations:

$$1.5 \leqq V_{PP} \leqq 2.0, \text{ and } |V_o - V_i|/2 \leqq |V_{DC}|$$

where $V_{PP}$ (kV) denotes a peak-to-peak value of said alternating voltage, $V_{DC}$ (V) denotes the direct voltage, $V_o$ (V) denotes a potential of a non-image area of said image bearing member for bearing the electrostatic latent image thereon and $V_i$ (V) denotes a potential of an image area of the image bearing member.

6. A development device as claimed in claim 5, wherein the frequency f (Hz) of said alternating voltage satisfies a relation of 1000<f<5000.

7. A development device as claimed in claim 5, wherein said alternating voltage acts for a shorter period of time to effect an electric field in a toner leading direction toward the image bearing member than to effect the electric field in a toner leading direction toward the developer carrying member.

8. A development device for developing an electrostatic latent image formed on an image bearing member comprising:

a developer carrying member opposing the image bearing member across a predetermined gap therebetween and holding a toner thereon; and a power unit for applying an alternating voltage between the image bearing member and the developer carrying member, the development device satisfying relations:

$$-b \leqq 5\times10^9/f, \text{ and } 5\times10^8/f \leqq a \leqq 5\times10^9/f$$

where a (Ω) denotes a resistance component of an impedance of said developer carrying member, −b (Ω) denotes a capacitative reactance component of the impedance thereof, and f (Hz) denotes a frequency of said alternating voltage.

9. A development device as claimed in claim 8, wherein said developer carrying member comprises a conductive roller and a resilient layer formed thereon.

10. A development device as claimed in claim 9, wherein said resilient layer has a thickness of 2 mm or less.

11. A development device as claimed in claim 9, wherein said resilient layer is formed of an electron conductive material.

12. A development device as claimed in claim 8, wherein said power unit applies the alternating voltage and a direct voltage between the image bearing member and the developer carrying member and satisfies relations:

$$1.5 \leqq V_{PP} \leqq 2.0, \text{ and } |V_o - V_i/2 \leqq |V_{DC}|$$

where $V_{PP}$ (kV) denotes a peak-to-peak value of said alternating voltage, $V_{DC}$ (V) denotes the direct voltage, $V_o$ (V) denotes a potential of a non-image area of said image bearing member for bearing the electrostatic latent image thereon and $V_i$ (V) denotes a potential of an image area of the image bearing member.

13. A development device as claimed in claim 12, wherein the frequency f (Hz) of said alternating voltage satisfies a relation of 1000<f<5000.

14. A development device as claimed in claim 12, wherein said alternating voltage acts for a shorter period of time to effect an electric field in a toner leading direction toward the image bearing member than to effect the electric field in a toner leading direction toward the developer carrying member.

15. A development device for developing an electrostatic latent image formed on an image bearing member comprising:

a developer carrying member opposing the image bearing member across a predetermined gap therebetween and holding a toner thereon; and a power unit for applying an alternating voltage between the image bearing member and the developer carrying member, the development device satisfying a relation:

$$5\times10^8/f \leqq (a^2+b^2)^{1/2} \leqq 5\times10^9/f$$

where a (Ω) denotes a resistance component of an impedance of said developer carrying member, −b (Ω) denotes a capacitative reactance component of the impedance thereof, and f (Hz) denotes a frequency of said alternating voltage.

16. A development device as claimed in claim 15, wherein said developer carrying member comprises a conductive roller and a resilient layer formed thereon.

17. A development device as claimed in claim 16, wherein said resilient layer has a thickness of 2 mm or less.

18. A development device as claimed in claim 16, wherein said resilient layer is formed of an electron conductive material.

19. A development device as claimed in claim 15, wherein said power unit applies the alternating voltage and a direct voltage between the image bearing member and the developer carrying member and satisfies relations:

$$1.5 \leqq V_{PP} \leqq 2.0, \text{ and } |V_o - V_i/2 \leqq |V_{DC}|$$

where $V_{PP}$ (kV) denotes a peak-to-peak value of said alternating voltage, $V_{DC}$ (V) denotes the direct voltage, $V_o$ (V) denotes a potential of a non-image area of said image bearing member for bearing the electrostatic latent image thereon and $V_i$ (V) denotes a potential of an image area of the image bearing member.

20. A development device as claimed in claim 19, wherein the frequency f (Hz) of said alternating voltage satisfies a relation of 1000<f<5000.

21. A development device as claimed in claim 19, wherein said alternating voltage acts for a shorter period of time to effect an electric field in a toner leading direction toward the image bearing member than to effect the electric field in a toner leading direction toward the developer carrying member.

* * * * *